US006834586B1

(12) United States Patent
Ohsawa et al.

(10) Patent No.: US 6,834,586 B1
(45) Date of Patent: Dec. 28, 2004

(54) LITHOGRAPHIC METHOD AND LITHOGRAPHIC DEVICE, PLATE MAKING METHOD AND PLATE MAKING DEVICE, AND INK JET PRINTING METHOD AND PRINTING DEVICE

(75) Inventors: Sadao Ohsawa, Shizuoka (JP); Yusuke Nakazawa, Shizuoka (JP); Kazuo Ishii, Shizuoka (JP); Eiichi Kato, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/980,112

(22) PCT Filed: May 31, 2000

(86) PCT No.: PCT/JP00/03493

§ 371 (c)(1),
(2), (4) Date: Nov. 30, 2001

(87) PCT Pub. No.: WO00/73065

PCT Pub. Date: Dec. 7, 2000

(30) Foreign Application Priority Data

| | | |
|---|---|---|
| May 31, 1999 | (JP) | 11/152865 |
| Nov. 30, 1999 | (JP) | 11/340787 |
| Dec. 6, 1999 | (JP) | 346323 |
| Dec. 21, 1999 | (JP) | 363271 |

(51) Int. Cl.[7] ..... B41C 1/10
(52) U.S. Cl. ..... 101/466; 347/41
(58) Field of Search ..... 101/463.1, 465, 101/466, 467, 401.1, 425, 488; 347/9, 12, 14, 19, 20, 22, 40, 41, 42, 55, 84, 101, 102

(56) References Cited

U.S. PATENT DOCUMENTS

| | | | | |
|---|---|---|---|---|
| 4,069,486 A | * | 1/1978 | Fox | 347/41 |
| 4,162,502 A | * | 7/1979 | Cielo et al. | 347/55 |
| 4,555,712 A | * | 11/1985 | Arway et al. | 347/89 |
| 4,593,296 A | * | 6/1986 | Dagna | 347/55 |

(List continued on next page.)

FOREIGN PATENT DOCUMENTS

| | | | |
|---|---|---|---|
| JP | 58-147373 | * | 9/1983 |
| JP | 60-110458 | | 6/1985 |
| JP | 64-27953 | | 1/1989 |
| JP | 02-95862 | | 4/1990 |
| JP | 04-43046 | | 2/1992 |
| JP | 04-043036 A | | 2/1992 |
| JP | 04-69245 | | 3/1992 |
| JP | 04-97848 | | 3/1992 |
| JP | 10-202822 | | 8/1998 |
| JP | 10-286939 | | 10/1998 |
| JP | 10-329325 A | | 12/1998 |
| JP | 11-048486 A | | 2/1999 |
| WO | 99/34982 | * | 7/1999 |

*Primary Examiner*—Stephen R. Funk
(74) *Attorney, Agent, or Firm*—Sughrue Mion, PLLC

(57) ABSTRACT

An on-press recording type lithographic printing method comprising mounting a plate material on a plate cylinder of a press, ejecting an oil-based ink onto the plate material from a recording head having a plurality of ejection channels utilizing an electrostatic field according to signals of image data to directly form an image on the surface of the plate material and prepare a printing plate, and then effecting the lithographic printing using the printing plate as it is, wherein the distance of the ejection channels is 170 $\mu$m, or more (150 dpi (150 dots per inch) or less as calculated in terms of resolution of recorded image).

6 Claims, 12 Drawing Sheets

U.S. PATENT DOCUMENTS 4,751,531 A 6/1988 Saito et al.
5,001,496 A * 3/1991 Vermot-Gaud et al. ..... 347/55
5,322,015 A * 6/1994 Gasparrini ..... 101/425
5,363,132 A * 11/1994 Ikkatai ..... 347/24
5,485,183 A * 1/1996 Zandian et al. ..... 347/41
5,790,149 A * 8/1998 Abe et al. ..... 347/40
5,881,646 A * 3/1999 Nagata et al. ..... 101/487
5,923,346 A * 7/1999 Mills et al. ..... 347/11
6,213,585 B1 * 4/2001 Kikuchi et al. ..... 347/41
6,367,912 B1 * 4/2002 Kishimoto et al. ..... 347/43
6,412,916 B1 * 7/2002 Okano et al. ..... 347/55
6,428,149 B1 * 8/2002 Mizuyama et al. ..... 347/55

* cited by examiner

LITHOGRAPHIC METHOD AND LITHOGRAPHIC DEVICE, PLATE MAKING METHOD AND PLATE MAKING DEVICE, AND INK JET PRINTING METHOD AND PRINTING DEVICE

TECHNICAL FIELD

The present invention relates to an ink jet recording method which provides an image having a good quality using a multiple channel head recording device. The invention further relates to an lithographic printing method and apparatus which carries out digital-plate making on a press using the ink jet recording method, a plate making method and apparatus which carries out the digital-plate making, and an ink jet printing method and apparatus.

BACKGROUND ART

As a method for applying an ink jet recording method to a printing system, a method for additionally printing variable numbers, marks, etc., on the same sheets of paper with the ink jet system by additionally attaching an ink jet printing apparatus to a rotary press has been disclosed in, for example, Japanese Patent Unexamined Publication No. Hei-10-286939.

It is preferable that high quality image information such as photographic images can be printed. However, since a great deal of liquid drops including much solvent is ejected in an ink technology for jetting aqueous or organic solvent-based ink, which includes conventional dyes or pigments as coloring agents, under pressure, there is a problem in that ink blurs out onto a printed image unless expensive specialty sheets of paper are used.

Therefore, where printing images on normal sheets of paper or plastic sheets of a non-absorbing type, no high quality printed image can be obtained.

In addition, as one of the ink jet technologies, there is a method in which ink that is solid in a normal temperature is heated and melted, and an image is formed by jetting the liquefied ink. The blurring of printed images may be reduced by using the ink. However, since the viscosity of the ink is high when ejecting the same, it is difficult to jet minute drops of ink, and individual dot images thus obtained become large in area and thick, wherein it is difficult to form highly fine images.

In the ink jet recording method using the conventional multiple channel head, when image recording is effected with an image resolution of 600 dpi, the various electrodes of the head each have a size of about 126 $\mu$m, which corresponds to about 200 dpi, under restrictions in working. Accordingly, explaining 4-channel head as an example as shown in FIG. 11, the various ejection electrodes 56-(1) to 56-(4) each move by two steps each being about 42 $\mu$m, which corresponds to 600 dpi, and skipped by 10 steps to continue image recording.

In this case, however, a so-called cross talk phenomenon occurs, causing ink particles to be exhausted in the head and hence reducing the diameter of dots thus formed or disabling ejection.

Further, adjacent ink droplets which have been ejected are off the course which they should follow during flying due to electrostatic repulsion, occasionally deteriorating the precision in the hitting position.

On the other hand, in the field of lithographic printing, ink receptive areas and ink repellent areas are formed on a surface of a printing plate in accordance with an original image. Printing ink adheres to the ink receptive areas to effect printing. Ordinarily, hydrophilic areas and oleophilic (ink receptive) areas are formed imagewise on the surface of a printing plate, and the hydrophilic areas are converted to oil-based ink repellent areas by applying dampening water thereto.

Conventional image recording (plate-making) on a printing original plate is carried out by exposing a silver salt photographic film with the desired image in an analog or digital manner, exposing a photopolymer material (printing original plate) containing a diazo resin or a photopolymerizable polymer to light through the silver halide photographic film, and then dissolving out the non-image areas mostly with an alkaline solution.

With recent improvements in digital recording technology and the demand for more efficient printing processes, various methods where digital image information is directly recorded on a printing original plate have been proposed in the field of lithographic printing method. These methods include technologies referred to a CTP (computer-to-plate) and a DDPP (digital direct printing plate) method. As the plate making method, there is provided a system where the image is recorded in a photon mode or heating mode using a laser beam. Some of these methods have been put to practical use.

However, after the image is recorded on a plate using either the photon mode or the heating mode, the non-image areas are dissolved out by treating the plate with an alkaline developer, resulting in the discharge of an alkaline waste liquid, which is environmentally undesirable.

As a means of carrying out the printing process at an enhanced efficiency there is proposed a system in which image recording is carried out on the press. The foregoing method involving the use of laser may be employed. However, this method requires an expensive and large-sized apparatus. Thus, a system utilizing an ink jet method which employs an inexpensive and compact image recording apparatus has been attempted.

Japanese Patent Unexamined Publication No. Hei. 4-97848 discloses a method which comprises forming an oleophilic or hydrophilic image on a plate drum, which is hydrophilic or oleophilic on the surface thereof instead of the conventional plate cylinder, by an ink jet process, and then removing the image after printing to clean the plate drum. However, this method is disadvantageous in that the desired removability of printed image (i.e., cleanability) and press life cannot be accomplished at the same time. In order to form a printed image having a prolonged press life on the plate cylinder, it is necessary that an ink containing a resin in a relatively high concentration be used. Thus, in the ink jet recording means for forming a printed image, the resin can be easily solidified due to the evaporation of solvent at the nozzle, deteriorating the stability in the ejection of ink. As a result, a good image can hardly be obtained.

Further, Japanese Patent Unexamined Publication No. sho. 64-27953 discloses a plate-making method which comprises recording an image of an oleophilic wax ink on a hydrophilic plate material by an ink jet process. In this method, since the image is formed of a wax, the resulting image area has a reduced mechanical strength and the adhesion of the image area to the hydrophilic surface of the plate material is insufficient, reducing the press life.

It is an object of the present invention to provide an ink jet recording method using a multiple channel head which can give an image having an extremely high and stable quality. Further, it is an object of the present invention to provide a lithographic printing method and apparatus for use with a digital recording system requiring no development process. It is another object of the present invention to provide a lithographic printing method and apparatus capable of providing a large number of prints having sharp images of high quality by an inexpensive apparatus and a simplified method. Further, it is still another object of the invention to provide a plate making method and a plate making apparatus for use with a digital recording system requiring no development process. In addition, it is still another object of the invention to further provide an ink jet printing method capable of providing a print having sharp images of high quality by an inexpensive apparatus and a simplified method.

DISCLOSURE OF THE INVENTION (1) An on-press recording type lithographic printing method comprising mounting a plate material on a plate cylinder of a press, ejecting an oil-based ink onto the plate material from a recording head having a plurality of ejection channels utilizing an electrostatic field according to signals of image data to directly form an image on the surface of the plate material and prepare a printing plate, and then effecting the lithographic printing using the printing plate as it is, wherein the distance of the ejection channels is 170 $\mu$m or more {150 dpi (150 dots per inch) or less as calculated in terms of resolution of recorded image}.

(2) The on-press recording type lithographic printing method according to (1), wherein said oil-based ink is a dispersion comprising resin particles which are solid and hydrophobic at least at ordinary temperature dispersed in a nonaqueous solvent having an inherent electrical resistance of $10^9$ Ω-cm or more and a dielectric constant of 3.5 or less.

(3) An on-press recording type lithographic printing apparatus comprising an image forming means for directly forming an image onto a plate material mounted on a plate cylinder of a press by using an ink jet recording device which ejects an oil-based ink from a recording head having a plurality of ejection channels according to signals of image data utilizing an electrostatic field, a lithographic printing means for effecting a lithographic printing using a printing plate formed by said image forming means, wherein image forming means includes the recording head having the distance of the ejection channels being 170 $\mu$m or more {150 dpi (150 dots per inch) or less as calculated in terms of resolution of recorded image}.

(4) The on-press recording type lithographic printing apparatus according to (3), wherein said oil-based ink is a dispersion comprising resin particles which are solid and hydrophobic at least at ordinary temperature dispersed in a nonaqueous solvent having an inherent electrical resistance of $10^9$ Ω-cm or more and a dielectric constant of 3.5 or less.

(5) The on-press recording type lithographic printing apparatus according to (3) or (4), wherein said image forming means includes a device for fixing the ink.

(6) The on-press recording type lithographic printing apparatus according to any one of (3) to (5), wherein said image forming means includes plate material surface dust removing means for removing dust present on the surface of the plate material before and/or during the recording of an image on the plate material.

(7) The on-press recording type lithographic printing apparatus according to any one of (3) to (6), wherein said image forming means carries out main scanning by rotations of the plate cylinder mounted on the plate material.

(8) The on-press recording type lithographic printing apparatus according to (7), wherein said ink jet recording-device carries out subscanning by the recording head approaching and seperating in an axial direction of said plate cylinder when recoding an image on said plate material.

(9) The on-press recording type lithographic printing apparatus according to any one of (3) to (8), wherein said ink jet recording device includes ink supplying means for supplying the oil-based ink into the recording head.

(10) The on-press recording type lithographic printing apparatus according to (9), further comprising ink recovering means for recovering the oil-based ink from the recording head, wherein ink circulation is carried out by the ink supplying means and the ink recovering means.

(11) The on-press recording type lithographic printing apparatus according to any of (3) to (10), further comprising ink stirring means in an ink tank housing the oil-based ink.

(12) The on-press recording type lithographic printing apparatus according to any of (3) to (11), further comprising ink temperature controlling means for controlling the temperature of the ink in the ink tank housing the oil-based ink.

(13) The on-press recording type lithographic printing apparatus according to any one of (3) to (12), further comprising an ink concentration controlling means for controlling the concentration of the ink.

(14) The on-press recording type lithographic printing apparatus according to any of (3) to (13), wherein said ink jet recording device includes recording head approaching and separating means for moving the recording head away from the plate cylinder except when recording the image on the plate material.

(15) The on-press recording type lithographic printing apparatus according to any of (3) to (14), wherein said image forming means includes recording head cleaning means for cleaning the recording head at least after the termination of plate making.

(16) The on-press recording type lithographic printing apparatus according to any of (3) to (15), wherein said lithographic printing means includes paper dust removing means for removing paper dust during lithographic printing.

(17) A plate making method comprising directly forming an image on a plate material and preparing a printing plate by recording using an ink jet method which ejects an oil-based ink from a recording head having a plurality of ejection channels according to signals of image data utilizing an electrostatic field, a lithographic printing means for effecting a lithographic printing using a printing plate formed by said image forming means, wherein the formation of the image onto the plate material is carried out by the recording head having the distance of the ejection channels being 170 $\mu$m or more {150 dpi (150 dots per inch) or less as calculated in terms of resolution of recorded imager}.

(18) The plate making method according to (17), wherein said oil-based ink is a dispersion comprising resin particles which are solid and hydrophobic at least at ordinary temperature dispersed in a nonaqueous solvent having an inherent electrical resistance of $10^9$ Ω-cm or more and a dielectric constant of 3.5 or less.

(19) A plate making apparatus comprising image forming means for directly forming an image on a plate material by an ink jet recording device which ejects an oil-based ink from a recording head having a plurality of ejection channels according to signals of image data utilizing an electrostatic field, wherein the formation of the image onto the plate material is carried out by the recording head having the distance of the ejection channels being 170 $\mu$m or more {150 dpi (150 dots per inch) or less as calculated in terms of resolution of recorded image}.

(20) The plate making apparatus according to (19), wherein said oil-based ink is a dispersion comprising resin particles which are solid and hydrophobic at least at ordinary temperature dispersed in a nonaqueous solvent having an inherent electrical resistance of $10^9$ Ω-cm or more and a dielectric constant of 3.5 or less.

(21) The plate making apparatus according to (19) or (20), wherein said image forming means includes a device for fixing the ink.

(22) The plate making apparatus according to any one of Claims (19) to (21), wherein said image forming means includes plate material surface dust removing means for removing dust present on the surface of the plate material before and/or during the recording of an image on the plate material.

(23) The plate making apparatus according to any one of (19) to (22), wherein the image is recorded by causing a printing medium to move by rotating the drum having the plate material mounted thereon when recording an image on the plate material.

(24) The plate making apparatus according to (23), wherein the image is recorded by causing the recording head to move in an axial direction of said drum.

(25) The plate making apparatus according to any one of (19) to (22), wherein when recording the image on the plate material, subscanning is carried out by causing said plate material to move with the same pinched by at least a pair of capstan rollers.

(26) The plate making apparatus according to (25), wherein said recording head is moved in the direction orthogonal to a traveling direction of said plate material.

(27) The plate making apparatus according to any one of (19) to (26), wherein said ink jet recording device includes ink supplying means for supplying the oil-based ink into the recording head.

(28) The plate making apparatus according to (27), further comprising ink recovering means for recovering the oil-based ink from the recording head, where the ink circulation is carried out.

(29) The plate making apparatus according to any one of (19) to (28), wherein the ink jet recording device includes ink stirring means for stirring the oil-based ink in the ink tank housing the oil-based ink.

(30) The plate making apparatus according to any one of (19) to (29), wherein the ink jet recording device includes ink temperature controlling means for controlling the temperature of the oil-based ink in the ink tank housing the oil-based ink.

(31) The plate making apparatus according to any one of (19) to (30), wherein the ink jet recording device includes ink concentration controlling means for controlling the concentration of the oil-based ink.

(32) The plate making apparatus according to any one of (19) to (31), further comprises cleaning means for cleaning the recording head.

(33) A printing method comprising directly forming an image onto a printing medium and producing a print by an ink jet method which ejects an oil-based ink from a recording head having a plurality of ejection channels according to signals of image data utilizing an electrostatic field, wherein the formation of the image onto the printing medium is carried out by the recording head having the distance the image forming means includes the recording head having the distance of the ejection channels being 170 μm or more {150 dpi (150 dots per inch) or less as calculated in terms of resolution of recorded image}.

(34) The ink jet printing method according to (33), wherein said oil-based ink is a dispersion comprising colored particles which are solid and hydrophobic at least at ordinary temperature dispersed in a nonaqueous solvent having an inherent electrical resistance of $10^9$ Ω-cm or more and a dielectric constant of 3.5 or less.

(35) A printing apparatus comprising image forming means for directly forming an image onto a printing material by an ink jet recording device which ejects an oil-based ink from a recording head having a plurality of ejection channels according to signals of image data utilizing an electrostatic field, wherein the formation of the image onto the printing medium is carried out by the recording head having the distance the image forming means includes the recording head having the distance of the ejection channels being 170 μm or more {150 dpi (150 dots per inch) or less as calculated in terms of resolution of recorded image}.

(36) The printing apparatus according to (35), wherein said oil-based ink is a dispersion comprising colored particles which are solid and hydrophobic at least at ordinary temperature dispersed in a nonaqueous solvent having an inherent electrical resistance of $10^9$ Ω-cm or more and a dielectric constant of 3.5 or less.

(37) The printing apparatus according to (35) or (36), wherein the image forming means includes a device for fixing the ink.

(38) The printing apparatus according to any one of (35) to (37), further comprising dust removing means for removing dust present on the surface of the printing medium before and/or during the printing onto the printing medium.

(39) The printing apparatus according to any one of (35) to (38), wherein when recording onto the printing medium, the image is recorded via the printing medium by causing the printing medium to move by rotating an opposed drum, which is disposed at the position opposed to the recording head.

(40) The printing apparatus according to (39), wherein the image is recorded by causing said recording head to move in an axial direction of said opposed drum.

(41) The printing apparatus according to (35) to (38), wherein when recording onto the printing medium, the image is recorded by causing said printing medium to move with the same pinched by at least a pair of capstan rollers.

(42) The printing apparatus according to (41), wherein the image is recorded by causing said recording head to move in the direction orthogonal to a traveling direction of said printing medium.

(43) The printing apparatus according to any one of (35) to (42), wherein the ink jet recording device includes ink supplying means for supplying the oil-based ink into the recording head.

(44) The printing apparatus according to (43), further comprising ink recovering means for recovering the oil-based ink from the recording head, wherein the ink circulation is carried out.

(45) The printing apparatus according to any one of (35) to (44), wherein the ink jet recording device includes ink stirring means for stirring the oil-based ink in the ink tank housing the oil-based ink.

(46) The printing apparatus according to any one of (35) to (45), wherein the ink jet recording device includes ink temperature controlling means for controlling the temperature of the oil-based ink in the ink tank housing the oil-based ink.

(47) The printing apparatus according to any one of (35) to (46), wherein the ink jet recording device includes ink concentration controlling means for controlling the concentration of the oil-based ink.

(48) The printing apparatus according to any one of (35) to (47), further comprising cleaning means for cleaning the recording head.

BEST MODE FOR CARRYING OUT THE INVENTION

The cross talk phenomenon which arises with the conventional multiple channel head (head having a plurality of ejection electrodes) will be described in connection with FIG. 12 (example of 6-channel head) and FIG. 13 (example of 4-channel head).

Figure 12:
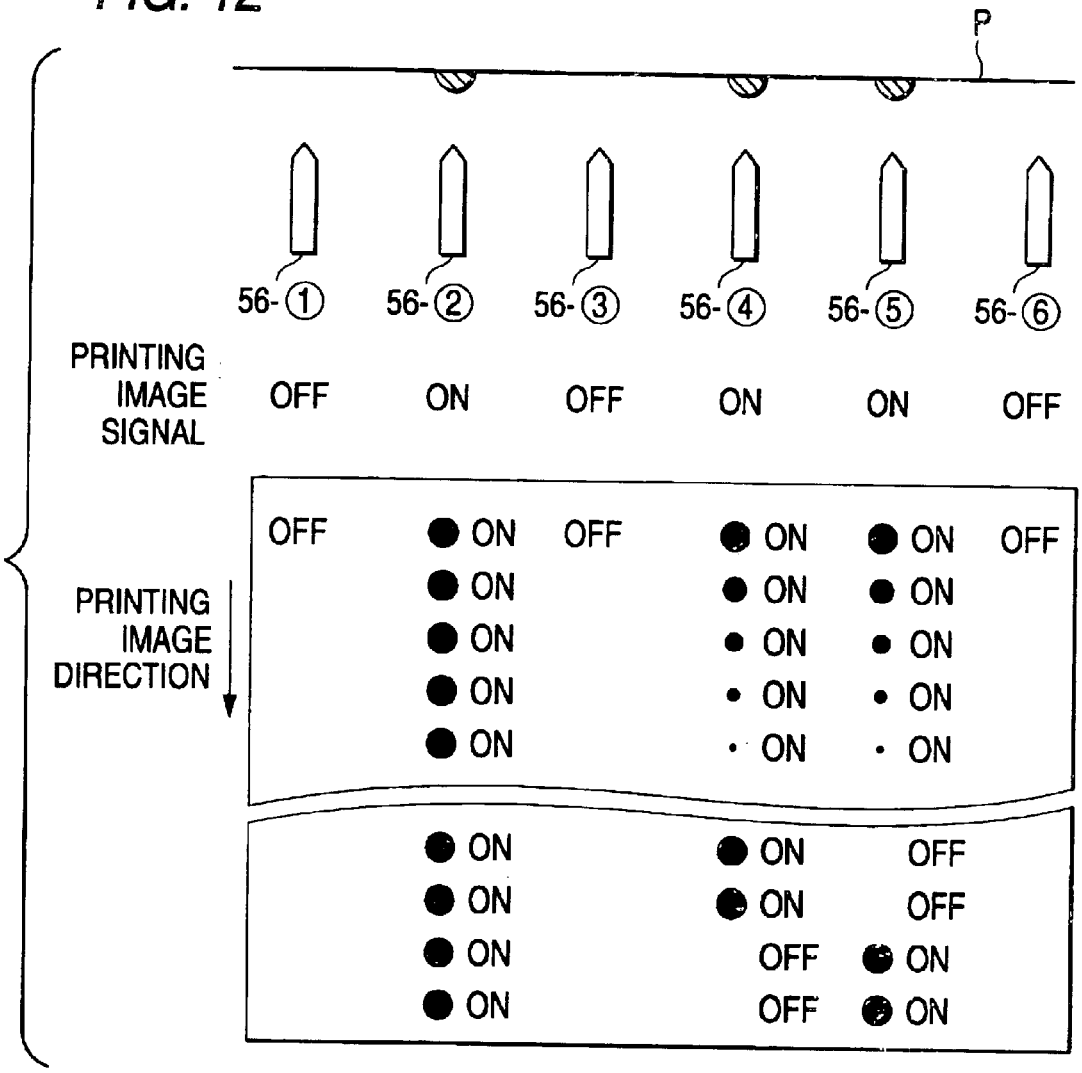
FIG. 12 is a view describing influences of the ejection electrode in the recording method of a 6-channel head.

As shown in FIG. 12, when ejection electrodes which are ON to receive image signals (electrodes 56-(4) and 56-(5)) are juxtaposed, as the image recording process proceeds in the direction of main scanning (rear end of the image), the supplied amount of ink decreases due to electrostatic repulsion, preventing the ink from being supplied into the ejection electrodes. Thus, it is thought that the ink particles are exhausted to produce dots having a reduced diameter or disable ejection.

As shown in FIG. 12, once image signals are OFF, and the ink is sufficiently supplied, image recording is made possible again. If the both end electrodes are OFF, this phenomenon can hardly occur. This is presumably because the effect of electric field extends over a certain range.

Figure 13:
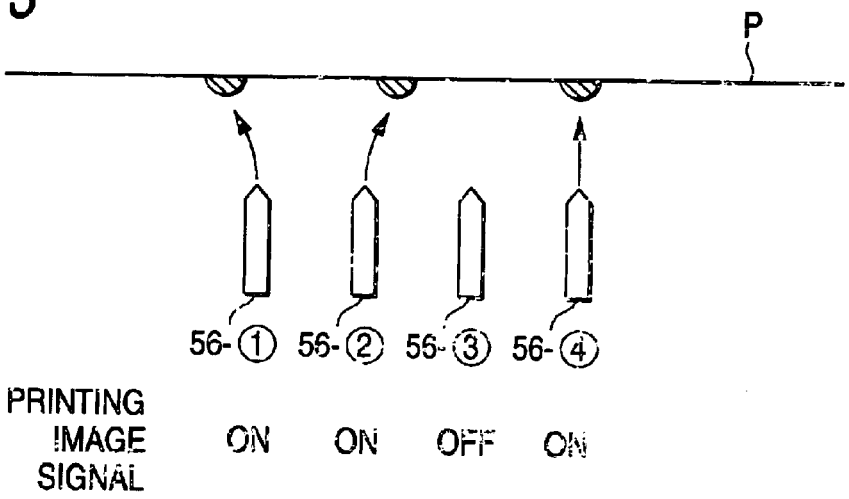
FIG. 13 is a view describing influences of a ejection electrode in a recording method of the four-channel head.

Similarly, as shown in FIG. 13, referring to the deflection of ejection of ink droplet, when ink droplets are ejected at the same time from juxtaposed electrodes, they repel each other due to electrostatic charge, deteriorating the precision in hitting position (electrodes 56-(1) and 56-(2)).

The ejection of the ink droplet from the outermost electrode at both ends is deflected outwardly whenever the adjacent electrode is ON (electrode 56-(1)).

The foregoing two phenomena may occur singly or in combination, presumably depending on the structure of the head, the physical properties of the ink, the structure of the ink passage, the conditions of voltage pulse applied during ejection, etc.

Then, the distance between the various ejection electrodes was studied. Thus, it has been found that the foregoing problem of cross talk can be fairly avoided by predetermining the distance between the respective ejection electrodes of the head greater than at least the distance between the horizontally adjacent dots to be ejected which is determined by the resolution of desired image to be recorded as described herein.

The embodiment of the present invention will be described hereinafter. In present invention, the distance between the ejection channels is preferably 170 μm or more (150 dpi or less as calculated in terms of resolution of recorded image), more preferably 250 μm or more (100 dpi or less). Where distance of adjacent dots, which is determined by the resolution of recorded images is smaller than the distance between ejection channels, as described above, it is possible to obtain a desired image by repeatedly performing a step of roughly all channel widths so that no gap is produced after a step of the distance of adjacent dots, which is determined by the resolution of recorded images being repeated a predetermined number of times.

Figure 11A:
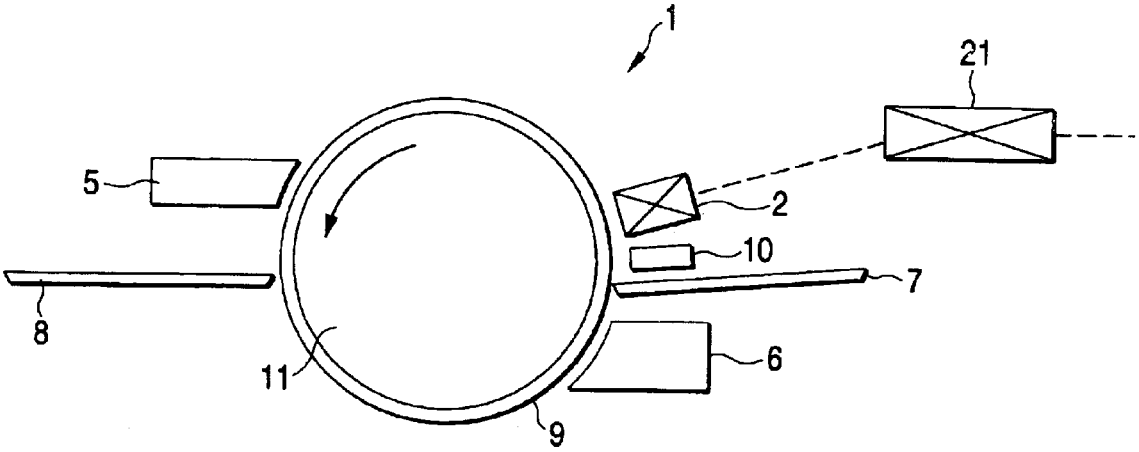
FIG. 11A is a general configurational view typically showing an example of a plate making apparatus used in the present invention.
Figure 11B:
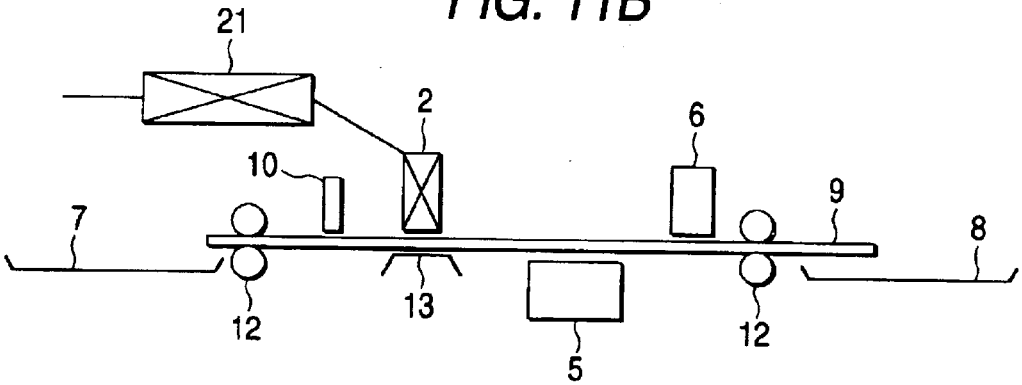
FIG. 11B is a general configurational view typically showing another example of a plate making apparatus used in the present invention.
Figure 11C:
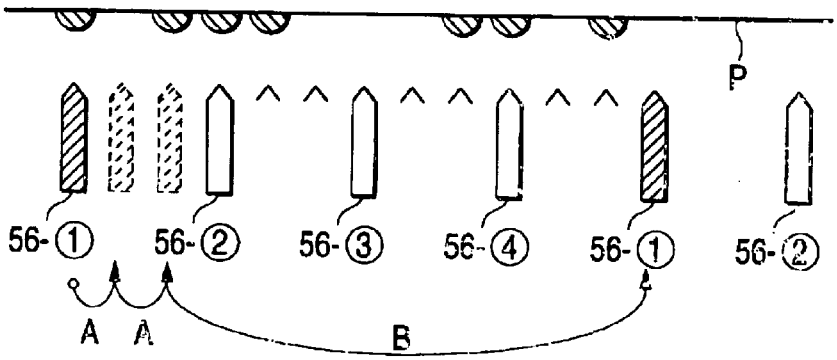
FIG. 11C is a view describing an recording method by a four-channel head.

Further, the desired resolution can be obtained by repeating a cycle comprising the movement of the head through the distance between the adjacent channels of the multiple channel head during image recording and the movement of the head through the distance between all the channel electrodes (corresponding to movement B in FIG. 11C).

The number of channels can be properly predetermined. In the case where the distance between the electrodes is large (in the case where dpi is small), when the number of channels remains the same, the entire width of the head is great, making it easy for the head to be worked.

The ink jet recording method of the invention involves the use of an ink having a high resistivity having resin particles which are solid and hydrophobic at least at ordinary temperature dispersed in an insulating solvent. In operation, the ink is subject to electrostatic field at the ejection position so that condensates of the resin particles are formed at the ejection position. The condensates are then ejected by an electrostatic means from the ejection positions. Specifically, an electrostatic ink jet method described in WO93/11866 may be used.

When the foregoing method is applied to plate making, the resin particles are ejected in the form of highly concentrated condensates, making it possible to print dots on the plate material to a sufficient thickness. In this manner, an image made of condensed resin particles having a sufficient press life is formed on the plate material as a recording medium. Further, since the resin particles are ejected in the form of highly concentrated condensates, and the droplet thus ejected has a small content of solvent, the ink can dry quickly, making it possible to prevent dots from running and hence form an image to a high precision.

In the ink jet method, the size of the ejected ink droplets is determined by the size of the tip end of ejection electrode, and the application condition of the applied electric field. In accordance with the ink jet recording method, minute ink droplets can be formed without reducing the ejection nozzle diameter or the ejection slit width. By controlling the application condition of the applied electric field, the diameter of dots formed on the recording medium can be controlled. Accordingly, minute image formation can be controlled without clogging the ink head and provide a large number of prints of sharp images.

The ink jet method of the invention is effected utilizing an electrostatic field. A strong electric field is preferably applied to the ink so that the ink is ejected. When the electric field thus applied is not sufficient, it is likely that a good ejectability cannot be obtained. Thus, the electric field to be applied is preferably about $1\times10^5$ V/cm or more. On the contrary, when the electric field thus applied is too high, dot split takes place or satellites are produced, showing a tendency toward image quality drop. Thus, the electric field to be applied is preferably about $1\times10^8$ V/cm or less. More preferably, the electric field to be applied is from $2\times10^5$ V/cm to $5\times10^7$ V/cm.

The on-press recording type ink lithographic printing method using the ink jet recording method will be described hereinafter Examples of the configuration of on-press recording type lithographic printing apparatus for use in the implication of the on-press recording type lithographic printing method according to the invention will be described hereinafter.

Figure 1:
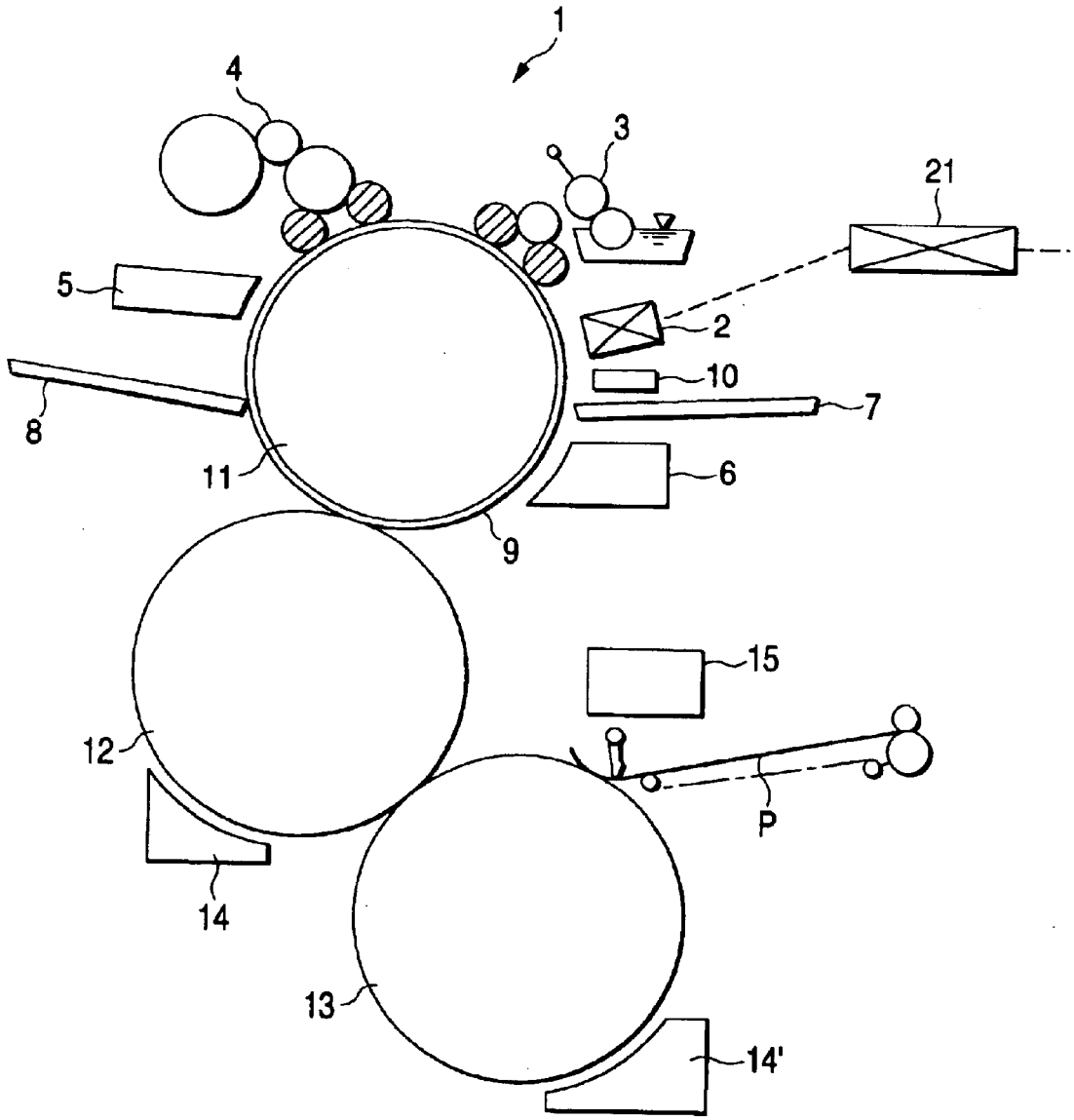
FIG. 1 is a general configurational view typically showing an example of a on-press recording type lithographic printing apparatus used in the present invention.
Figure 2:
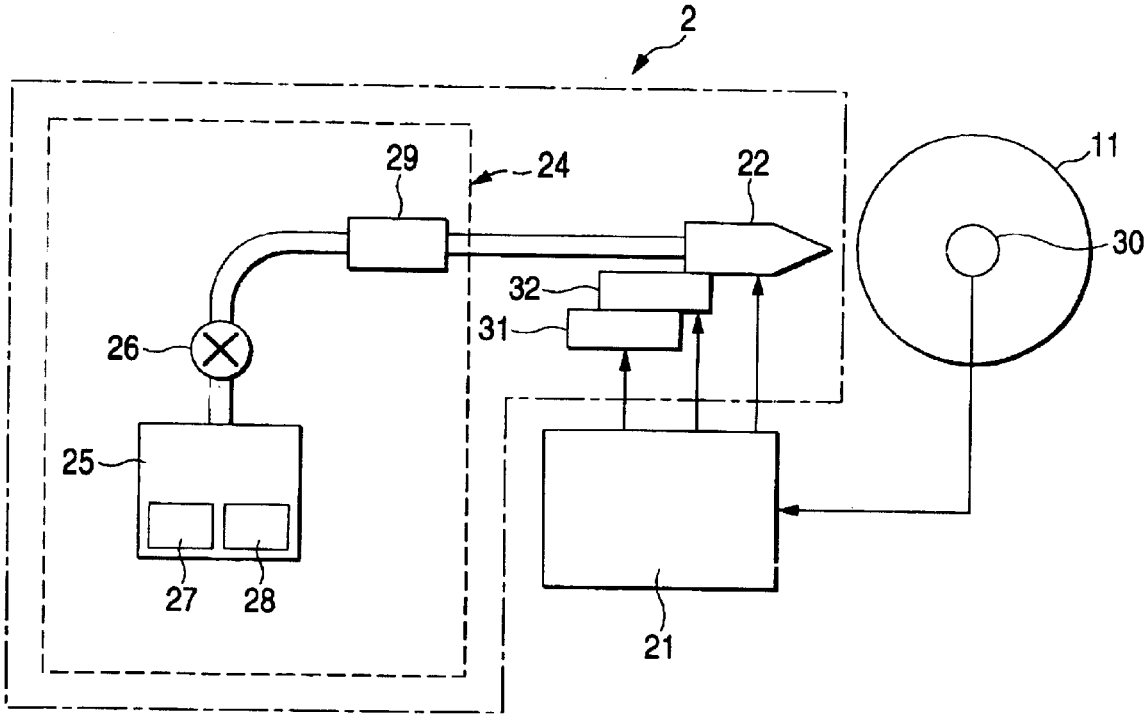
FIG. 2 is a configurational view typically showing an example of a recording portion of the on-press recording type lithographic printing apparatus used for the invention.
Figure 9:
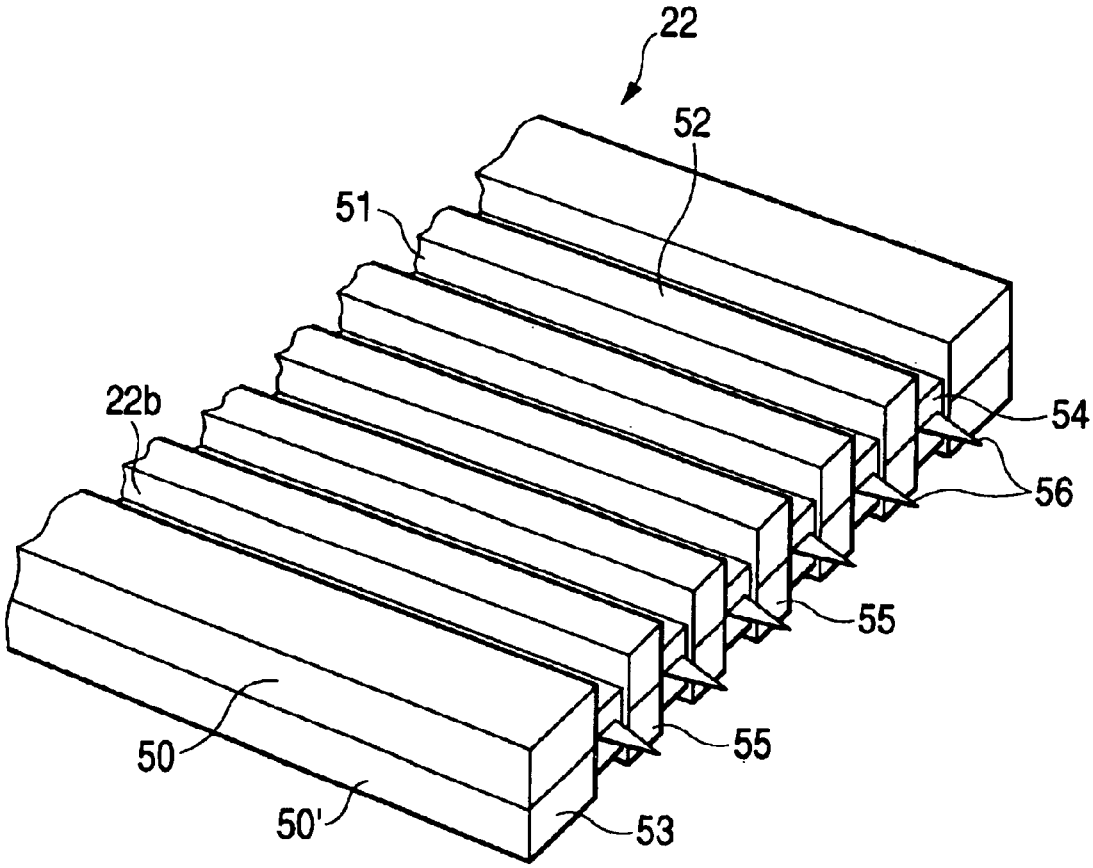
FIG. 9 is an outlined configurational view showing the major parts of an example of still another head incorporated in the ink jet recording device used in the present invention.
Figure 10:
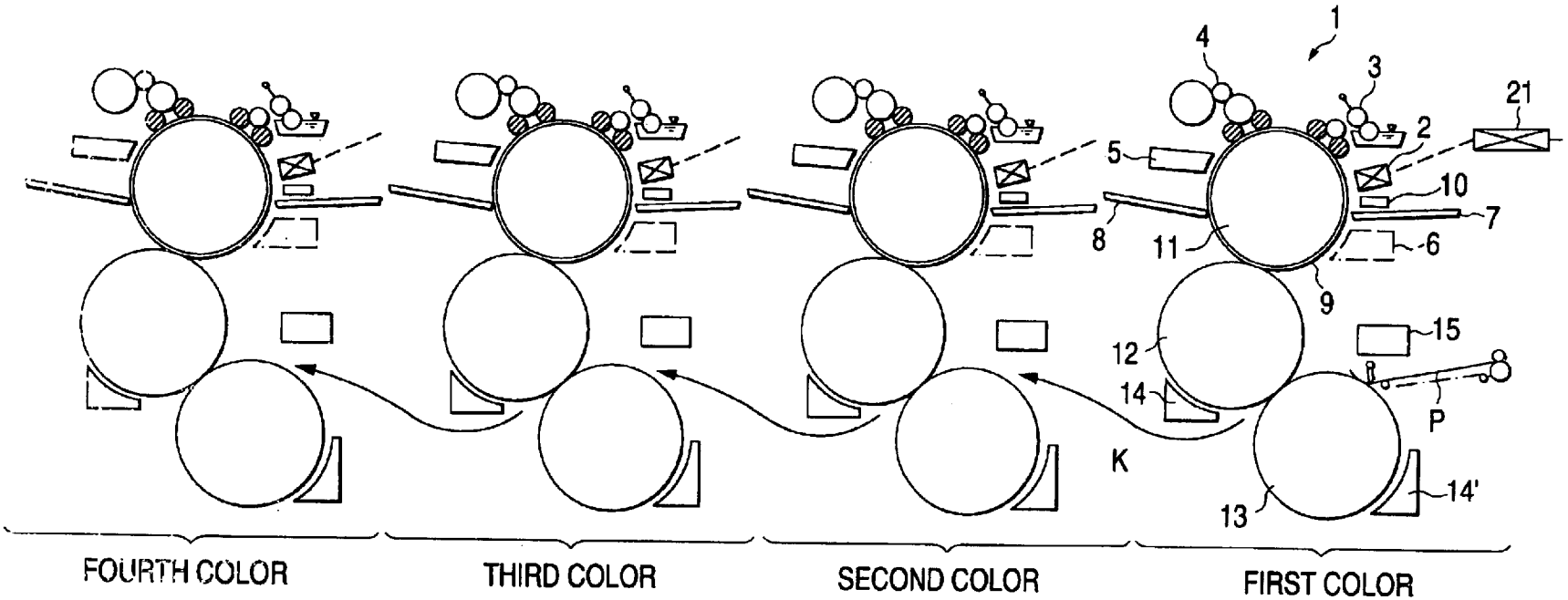
FIG. 10 is a general configurational view typically showing an example of an on-press recording type four-color single-sided lithographic printing apparatus as a multi-color machine used in the present invention.

FIG. 1 is a diagram illustrating the entire configuration of an on-press recording type monochromatic single-sided lithographic printing apparatus. FIG. 2 is a schematic diagram illustrating the configuration of the recording portion including a controller, an ink supplier and a mechanism for moving a head toward or away in the on-press recording type lithographic printing apparatus. Each of FIGS. 3 to 9 illustrates an ink jet recording device installed in the on-press recording type lithographic printing apparatus shown in FIGS. 1 and 10. FIG. 10 is a diagram illustrating the entire configuration of an on-press recording type four-color single-sided lithographic printing apparatus according to the invention.

The printing process according to the invention will be described hereinafter in connection with the entire configuration of on-press recording type monochromatic single-sided lithographic printing apparatus shown in FIG. 1. As shown in FIG. 1, an on-press recording type lithographic printing apparatus 1 (hereinafter referred to as "printing apparatus") 1 has a plate cylinder 11, a blanket cylinder 12 and an impression cylinder 13 provided therein. The transferring blanket cylinder 12 is arranged so as to be pressed against the plate cylinder 11 at least during lithographic printing. The impression cylinder 13 for transferring a printing ink image which has been transferred to the blanket cylinder 12 to a printing paper P is arranged pressed against the blanket cylinder 12.

The plate cylinder 11 is usually made of a metal. The surface of the plate cylinder 11 is plated with chromium to enhance its abrasion resistance. The plate cylinder 11 may have a heat insulator on the surface thereof as described later. On the other hand, the plate cylinder 11 is preferably grounded because it acts as a counter electrode to an electrode of the ejection head during ejection under an electrostatic field. When the substrate of the plate material is a good insulator, it is preferable to provide a conductive layer on the substrate. In this case, the conductive layer is preferably grounded to the plate cylinder. In a case where a heat insulator is provided on the plate cylinder 11 as described above, recording is more easily accomplished by providing the plate material with a ground. Examples of the ground employable herein include a known conductive brush, plate spring, and roller.

The printing apparatus 1 also has an ink jet recording device (ink jet image depicting device) 2 which ejects an oil-based ink onto the plate material 9 mounted on the plate cylinder 11 in accordance with image data transmitted from an image data calculation controlling unit 21, to thereby form an image on the plate material.

The printing apparatus 1 further includes a dampening water supplier 3 installed therein for supplying dampening water onto the hydrophilic portion (non-image area) on the plate material 9. FIG. 1 illustrates a Morton process water supplier as a typical example of the dampening water supplier 3. Other examples of the dampening water supplier 3 employable herein include known apparatus such as synchronous process water supplier and continuous process water supplier.

The printing apparatus 1 further includes a printing ink supplier 4 and a fixing device 5 for fixing the oil-based ink image formed on the plate material 9. Additionally, a plate surface oil-desensitizing device 6 may be installed for increasing the hydrophilic properties of the surface of the plate material 9 as necessary.

The printing apparatus 1 also has means 10 for removing dust present on the surface of the plate material before and/or during the process of recording the image on the plate material. Therefore, ink can be effectively prevented form being adhered onto the plate material by or along dust placed between the head and the plate material during the plate making, and satisfactory plate making can be carried out. Examples of the dust removing means include a contact method using a brush or a roller, in addition to a conventional non-contact method involving suction, blowing or electrostaticity. In the present invention, the removal method is preferably one that uses suction, blowing or a combination thereof. In this case, an air pump commonly used for paper supplier may be used for this purpose.

An automatic plate material supplying device 7 by which the plate material 9 for printing is fed automatically to the plate cylinder 11, and an automatic plate material discharging device 8 by which the plate material 9 is removed from the plate cylinder 11 after the printing process may be installed. Examples of the press machine having these devices, which are known as auxiliary devices for press, include HAMADA VS34A, B452A (produced by HAMADA PRINTING PRESS CO., LTD.), TOKO 8000PFA (produced by Tokyo Koku Keiki K.K.), RYOBI 3200ACD, 3200PFA (produced by Ryobi Imagics Co., Ltd.), AMSIS Multi5150FA (produced by Nihon AM Co., Ltd.), Oliber 266EPZ (produced by Sakurai Graphics Systems Co., Ltd.), and Sinohara 66IV/IVP (produced by Shinohara Shoji K.K.). Further, a blanket cleaner 14 and an impression cylinder cleaner 14' may be installed. The use of these devices 7, 8, 14 and 14' can make the printing operation simpler and shorter and the printing time shorter so that the effects of the invention can be further enhanced. Further, a paper dust generation inhibiting device (paper dust removing means) 15 may be installed in the vicinity of the plate cylinder 13, making it possible to prevent paper dust from adhering to the plate material. The paper dust generation inhibiting device 15 can operate by humidity control, suction by air or electrostaticity, or the like.

The image data calculation controlling unit 21 receives image data from, e.g., an image scanner, a magnetic disk device or an image data communication device, and not only carries out color separation but also processing of the separated data into appropriate numbers of pixels and gradations. In addition to these operations, the controlling unit 21 calculates dot position and dot area percentage in order to enable the recording of oil-based ink images in halftone dots by means of an ejection head 22 as recording head (see FIG. 2 explained in detail hereinafter) with which the ink jet recording device 2 is equipped.

Furthermore, as described below, the image data calculation controlling unit 21 controls the movement of the ink jet ejection head 22 and the time at which the oil-based ink is ejected and, if desired, the timing of the rotation of the plate cylinder 11, the blanket cylinder 12, the impression cylinder 13, etc.

A method of preparing a printing plate using the printing apparatus 1 is described in detail below with reference to FIG. 1 and a part of FIG. 2.

The plate material 9 is first mounted on the plate cylinder 11 using the automatic plate material supplying device 7. The plate material is brought into close contact with and fixed firmly to the plate cylinder by means of a well-known mechanical device such as a plate top/tail gripping device or an air suction device, or by a well-known electrostatic device. Due to this firm fixation, the tail end of the plate material 9 is prevented from flapping against, and bringing into contact with and thus damaging the ink jet recording device 2 during the recording process. Also, it is possible to prevent the plate material 9 from being brought into contact with the ink jet recording device by using an arrangement which brings the plate material into close contact with the plate cylinder only in the neighborhood of the recording position of the ink jet recording device at least during recording the image. Specifically, the arrangement may be, for example, hold-down rollers disposed on both upstream and downstream sides of the recording position of the plate cylinder. Further, an arrangement may be provided such that the end of the plate material is kept away from the ink supplying roller at fixing the plate material, making it possible to inhibit stain on the surface of the printing plate and hence reduce the number of sheets of waste paper. Specifically, hold-down rollers, guides, electrostatic attraction, etc. are effective.

Image data from a magnetic disc device or the like is given to the image date calculation controlling unit 21. The image date calculation controlling unit 21 then calculates the ejection position of oil-based ink and dot area percentage at the ejection position according to the image data thus inputted. The calculation data input to the image date calculation controlling unit 21 is temporarily stored in a buffer. The image date calculation controlling unit 21 instructs the rotation of the plate cylinder 11 and, at the same time, moves the ejection head 22 towards the plate cylinder 11 by an ejection head approaching and separating device (recording head approaching and separating means) 31. The distance between the ejection head 22 and the surface of the plate material 9 mounted on the plate cylinder 11 is maintained at a predetermined distance during recording by mechanical distance control, e.g., using a contact roller or by controlling the ejection head approaching and separating device in accordance with signals from an optical distance detector. Such distance control prevents the dot diameters from being made uneven due to floating of a plate material and also ensures no change in dot diameter even when the press is subjected to vibration. Thus, satisfactory plate making can be accomplished.

When recording an image, main scanning is carried out by rotations of the plate cylinder 11. The ejector is arrayed and installed in the axial direction. The head 22 is moved by the image data calculation controlling unit 21 in the axial direction of the plate cylinder per rotation of the plate cylinder 11, and oil-based ink is ejected onto the plate material 9 mounted on the plate cylinder 11 at the ejection position and dot area percentage which are obtained by the above-described calculation. As a result, a dot image with gradations corresponding to the original print is recorded with the oil-based ink on the plate material 9. These operations are continued until the oil-based ink image corresponding to one-color information of the original print is formed on the plate material to prepare a printing plate.

Subsequently, the ejection head 22 is moved away from the position close to the plate cylinder 11 in order to protect the ejection head 22. During this operation, only the ejection head may be moved away from the plate cylinder 11. However, the ejection head 22 may be moved away from the plate cylinder 11 together with a head subsidiary scanner 32 or together with the ink supplier 24 and the head subsidiary scanner 32. Alternatively, an arrangement may be made such that the fixing device 5 and the dust remover 10 can be provided with head approaching and separating means and they are moved away from the plate cylinder 11 in the same manner as the ejection head 22, the ink supplier 24 and the head subsidiary scanner 32, whereby the printing apparatus can be used also in ordinary printing.

The head approaching and separating means operates so as to keep the recording head at least 500 $\mu$m away from the plate cylinder except during image recording. This movement may be effected using a sliding system or a mechanism by which the head is gripped with an arm fixed on a shaft and moved in a pendulum-like motion by operating the arm around the shaft. By keeping the head away from the plate cylinder when image formation is not being carried out, the head is protected from physical damage and contamination. As a result, the life of the head can be extended.

The oil-based ink image formed by the head is hardened by heating or like device using a fixing device 5. Well-known fixing techniques, such as heat fixing, solvent fixing and the like, can be employed for fixing the ink image. In the case of heat fixing, irradiation with an infrared lamp, a halogen lamp, or xenon flash lamp, hot air fixing using a heater or fixing using a heated roller can be usually used. In such a case, for increasing the fixing efficiency measured made be adopted such as preheating the plate cylinder, preheating the plate material, performing the recording under exposure to hot air, using a plate cylinder coated with a heat insulator, or heating the plate material alone by separating the plate material from the plate cylinder only at the time of fixing. Flash fixing using, e.g., a xenon lamp, is well-known as a fixing method for electrophotographic toner, and has the advantage of performing the fixing in a short time.

In the case of solvent fixing, a solvent capable of dissolving the resin component of the ink, such as methanol and ethyl acetate, is sprayed onto the plate material, and the excess solvent vapor is recovered. Also, at least in the process from formation of an oil-based ink image by the ejection head 22 to fixation by the fixing unit 5, it is preferable that the dampening water supplier 3, printing ink supplier 4, and blanket cylinder 12 are held so that these are not brought into contact with the plate material 9 on the plate cylinder.

The printing plate thus prepared is then subjected to printing process in the same manner as known lithographic printing method. More specifically, the printing plate 9 having the oil-based ink image formed thereon is given a printing ink and a dampening water to form a printing ink image thereon. The printing ink image thus formed is transferred onto the blanket cylinder 12 rotating in concert with the plate cylinder 11, and then the printing ink image on the blanket cylinder 12 is transferred to printing paper passing between the blanket cylinder 12 and the impression cylinder 13 to conduct printing corresponding to one-color information of the original. After the printing operation, the plate material 9 is removed from the plate cylinder 11 by an automatic plate remover 8, and a blanket on the blanket cylinder 12 is cleaned with a blanket cleaning device 14 so that it is restored to a printable state.

The ink jet recording device 2 will be described in more detail below.

The image recording portion used in the lithographic printing apparatus of the invention comprises an ink jet recording device 2, and an ink supplier 24, as shown in FIG. 2. The ink supplier 24 has an ink tank 25, an ink supplying device 26 and an ink concentration controlling device 29. The ink tank 25 is furnished with a ink stirrer 27 and an ink temperature controlling device (ink temperature controlling means) 28. The ink may be circulated through the ejection head. In this case, the ink supplier also has a recovering function. The ink stirrer 27 inhibits the solid component of the ink from precipitating and aggregating so that the necessity of the cleaning of ink tank is reduced. Examples of the ink stirrer include a rotating blade, an ultrasonic vibrator and a circulatory pump. These tools can be used singly or in combination. The ink temperature controlling device 28 is arranged so as to prevent the physical properties of the ink from changing due to change in ambient temperature, thereby ensuring no change in dot diameter so as to form a consistently high-quality image. To control the ink temperature, a well-known method can be adopted. More specifically, the ink tank can be provided with a heating element such as a heater or a Peltie element or a cooling element together with the stirrer so as to make the temperature distribution inside the ink tank uniform, and the temperature is controlled with a temperature sensor such as thermostat. It is desirable that the ink temperature inside the ink tank be from 15° C. to 60° C., and preferably from 20° C. to 50° C. The ink stirrer may be used for both purposes of keeping the temperature distribution uniform and for preventing precipitation and aggregation of the solid component of the ink.

For achieving high-quality image formation, it is preferred that the printing apparatus of the present invention further be provided with an ink concentration controlling device 29. This device makes it possible to effectively prevent blurring on the plate and missing or blank portions in the printed image due to a decrease of solid concentration in the ink or changes of dot diameter due to increase of the solid concentration in the ink. Ink concentration control is carried out by optical detection, measurement of physical properties such as electric conductivity or viscosity, or monitoring a number of plate materials subjected to image formation. More specifically, the ink concentration is controlled by feeding concentrated ink from an ink tank for replenishment or ink carrier tank for dilution (not shown) in accordance with output signals from an optical detector, a conductivity measuring instrument and a viscosity measuring instrument provided individually or in combination inside the ink tank, or ink flow course in the case of control in accordance with measurement of physical properties, or based on a number of plate making or a frequency of plate-making operations in the case of monitoring the number of plate materials subjected to image formation.

The image data calculation controlling unit 21, as described above, not only performs calculation operations on input image data and controls movement of the ejection head with the ejection head approaching and separating device 31 or the head subsidiary scanner 32 and rotation of the plate cylinder, but also receives a timing pulse from an encoder 30 attached to the plate cylinder and carries out operation of the ejection head in accordance with the timing pulse. As a result, positional precision in the direction of subsidiary scanning is improved. During the image recording by the ink jet recording device, the use of a driving unit having a high precision different from the driving unit for printing allows the plate cylinder to be driven in an enhanced positional precision in the direction of subsidiary scanning. During this procedure, the plate cylinder is preferably released mechanically from the blanket cylinder, the impression cylinder and others so that only the plate cylinder can be driven. More specifically, the output from a high precision motor can be subjected to reduction through a high precision gear, steel band or the like to drive only the plate cylinder. During the recording of a high quality image, these devices may be used singly or in combination.

The ejection head will now be described in more detail with reference to FIGS. 3 to 9. However, the present invention should not be construed as being limited thereto.

Figure 3:
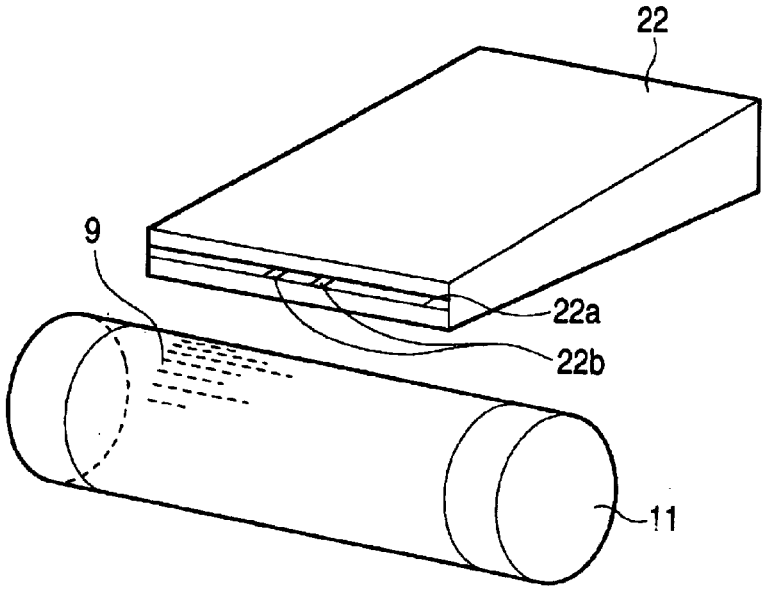
FIG. 3 is an outlined configurational view showing an example of a head incorporated in an ink jet recording device used in the present invention.
Figure 4:
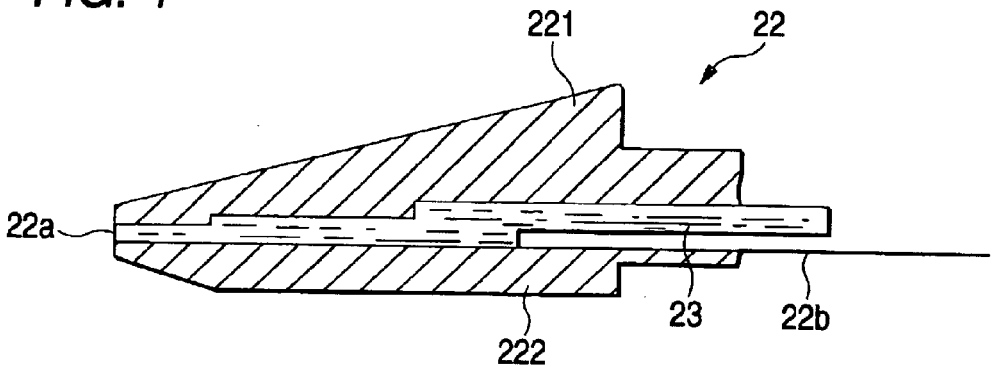
FIG. 4 is an outlined sectional view showing the vicinity of the ink ejector in FIG. 3.

FIGS. 3 and 4 show an example of an ejection head which is installed in the ink jet recording device. The head 22 has a slit interposed between an upper unit 221 and a lower unit 222, Peach formed by an insulating substrate, while the tip thereof forms an ejection slit 22*a*. An ejection electrode 22*b* is arranged in the slit, and the slit is filled with an ink 23 supplied from an ink supplying device. Examples of the insulating substrate usable for the head include plastics, glass and ceramics. The ejection electrode 22*b* is formed on the lower unit 222 made of an insulating substrate according to a known method. For instance, the top surface of the lower unit 222 may be provided with a conductive material such as aluminum, nickel, chromium, gold or platinum using a technique such as vacuum deposition, sputtering or electroless plating, and then the conductive material coating is covered with a photoresist. The photoresist is exposed to light via a desired electrode pattern and developed to form a photoresist pattern in the form of the ejection electrode 22*b*. Then, the conductive material coating undergoes etching, mechanical removal or a combination thereof to form the ejection electrode 22*b*.

During operation of the head 22, a voltage is applied to the ejection electrode 22*b* in accordance with digital signals corresponding to image pattern information. As shown in FIG. 3, the ejection electrode 22*b* is arranged facing the plate cylinder 11 so as to constitute a counterelectrode, and the plate material 9 is mounted on the plate cylinder 11 as the counterelectrode. Upon application of voltage, a circuit is formed between the ejection electrode 22*b* and the plate cylinder 11 acting as the counterelectrode, and the oil-based ink 23 is ejected from the ejection slit 22*a* of the ejection head 22 to form an image on the plate material 9 mounted on the plate cylinder 11 as the counterelectrode.

In order to form a high-quality image, it is preferred that the tip of the ejection electrode 22*b* is made as small as possible. The tip of the electrode is ordinarily shaped so as to have a width of from 5 to 100 $\mu$m, although the tip width may be varied depending on conditions, such as applied voltage, ink material and the like.

For instance, a dot having a diameter of 40 $\mu$m can be formed on the plate material 9 when the ejection electrode 22*b* having a tip width of 20 $\mu$m is used, the space between the ejection electrode 22*b* and the plate cylinder 11 as a counterelectrode is adjusted to 1.0 mm, and a voltage of 3 kV is applied for 0.1 millisecond between these electrodes.

Figure 5:
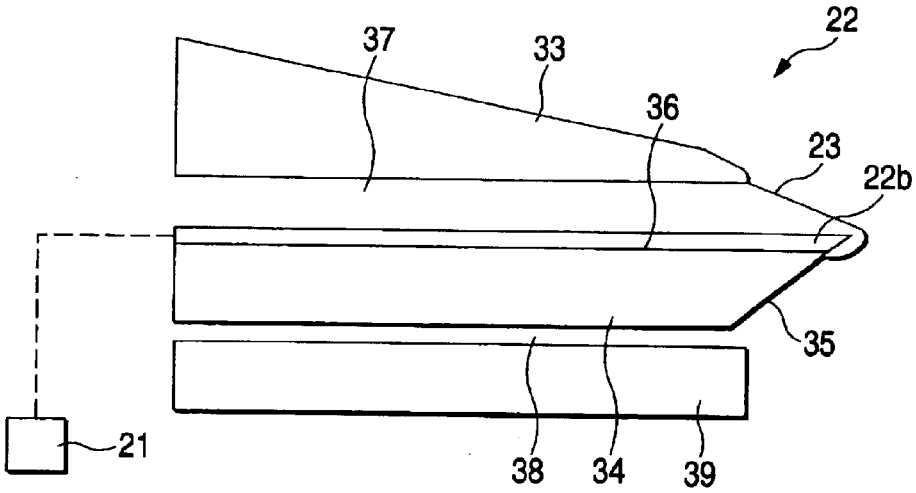
FIG. 5 is an outlined sectional view showing the vicinity of the ink ejector in an example of another head incorporated in the ink jet recording device used in the present invention.
Figure 6:
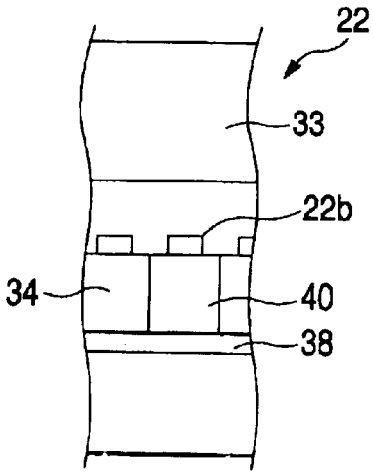
FIG. 6 is an outlined front side view showing the vicinity of the ink ejector in FIG. 5.

FIGS. 5 and 6 respectively show a schematic cross-sectional view and a schematic front view of the vicinity of an ink ejector of another example of the ejection head. Reference numeral 22 in these figures indicates the ejection head. The head has a first insulating substrate 33 of a tapered shape. A second insulating substrate 34 is set facing to and apart from the first insulating substrate 33. An end portion of the second insulating substrate 34 has a slope 35. The first and second insulating substrates are each made of, e.g., plastics, glass or ceramics. On a top surface 36 of the second insulating substrate 34, which makes a sharp angle with the slope 35, a plurality of ejection electrodes 22*b* are provided for forming an electrostatic field in the ejector. The tips of the ejection electrodes 22*b* extend to the vicinity of the tip of the top surface 36, and protrude beyond the tip of the first insulating substrate 33, thereby forming the ejectors. An ink flow course 37, defining a pathway for supplying ink 23 to the ejector, is formed between the first and second insulating substrates 33 and 34, and the ink recovery course 38 is formed on the underside of the second insulating substrate 34. The ejection electrodes 22*b* are formed using a conductive material such as aluminum, nickel, chromium, gold or platinum on the top surface of the second insulating substrate 34 in a conventional manner as described above. The respective ejection electrodes 22*b* are constructed so as to be in an electrically insulated state.

A suitable length for the tip of the ejection electrode 22*b* that protrude beyond the tip of the first insulating substrate 33 is 2 mm or less. A reason why such a range of protrusion is preferred is that, if the protrusion is too long, it is difficult for the ink meniscus to reach the tip of ejector, resulting in difficulty in ejection of the ink and a decrease in maximum recording frequency. In addition, it is preferred that the space between the first and second insulating substrates 33 and 34 be from 0:1 to 3 mm. A reason why this range is preferred for the space is that too narrow a space makes supply of the ink difficult, resulting in difficulty in ejection of the ink and a decrease in maximum recording frequency. On the other hand, too wide a space makes the meniscus unstable, resulting in inconsistent ejection of the ink.

The ejection electrode 22*b* is connected to the image date calculation controlling unit 21. In carrying out recording, a voltage is applied to the ejection electrode in accordance with image information signals from the image date calculation controlling unit 21, and thereby the ink on the ejection electrode is ejected to perform image formation on a plate material (not shown) arranged to be facing to the ejector. The ink inflow course 37 is connected to a device for sending ink from an ink supplying device (not shown) on the side opposite to the ink ejector. Further, a backing 39 is arranged apart from and facing toward the underside, which is the reverse of the ejection electrode side, of the second insulating substrate 34 to form an ink recovery course 38 between them. It is preferred that the width of the space of the ink recovery course 38 be at least 0.1 mm. This is because too small a space makes the recovery of ink difficult, resulting in ink leakage. The ink recovery course 38 is connected to an ink recoverer, which is attached to the ink supplying device (not shown).

If a uniform ink flow over the ejector is required, grooves 40 may be provided between the ejector and the ink recoverer. FIG. 6 is a front view showing the vicinity of the ejector of an ejection head. As shown in FIG. 6, a plurality of grooves 40 are provided in the slope of the second insulating substrate 34 from the vicinity of the borders with the respective ejection electrodes 22 to the ink recovery course 38 . The grooves 40 are aligned in the lengthwise direction of the ink jet electrode 22*b*, and have a function for conducting by capillary action a predetermined amount of ink, depending on the opening diameter, present in the vicinity of the tip of each ejection electrode from the respective openings on the side of ejection electrodes 22*b* into the ink recovery course 38. The grooves 40 function to form an ink flow having a certain thickness in the vicinity of the tip of each ink jet electrode. The groove 40 may have any shape as far as the grooves can provide the desired capillary action. However, it is especially desirable that the width of the grooves is from 10 to 200 $\mu$m and the depth thereof is from 10 to 300 $\mu$m. The grooves 40 are provided in a number sufficient for forming a uniform ink flow over the entire ejection head.

In order to effect formation, e.g., printing of a high-quality image, it is preferred that the tip of the ejection electrode 22*b* be made as small as possible. The tip of the electrode is ordinarily shaped so as to have a width of from 5 to 100 μm, although the tip width may be varied depending on conditions, such as applied voltage, ink material and the like.

Figure 7:
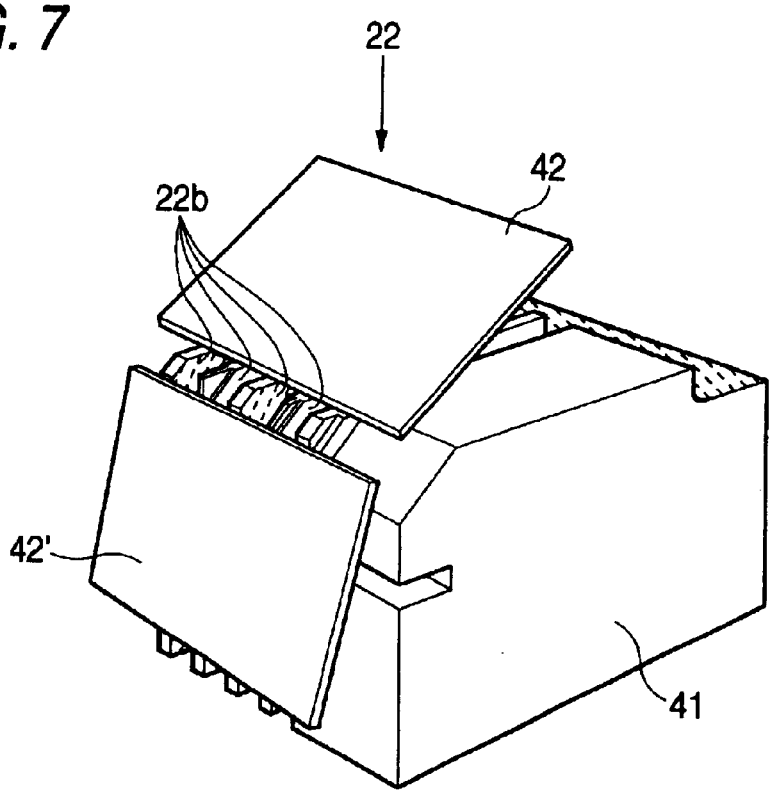
FIG. 7 is an outlined configurational view showing the major parts of an example of still another head incorporated in the ink jet recording device used in the present invention.
Figure 8:
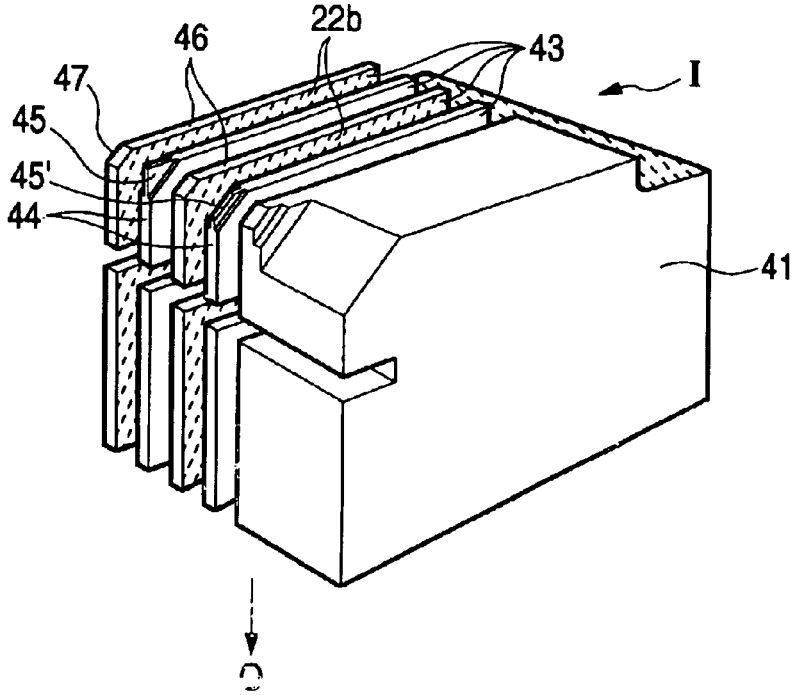
FIG. 8 is an outlined configurational view of a head, from which a separator wall is removed, in FIG. 7.

Still another example of the ejection head for use in the present invention is shown in FIGS. 7 and 8. FIG. 7 is a schematic diagram illustrating only a portion of the head. The recording head 22, as shown in FIG. 7, has a main body 41 made of an insulator material such as plastics, ceramics or glass, and meniscus regulating panels 42 and 42'. Reference numeral 22*b* in FIG. 7 indicates an ejection electrode to which a voltage is applied to form an electrostatic field in the ejector. The main body of the head is further illustrated in detail with reference to FIG. 8 wherein the regulating panels 42 and 42' are removed from the ejection head.

The main body 41 of the head has a plurality of ink grooves 43 perpendicularly to the edge thereof for the purpose of ink circulation. The grooves 43 each may have any shape so far as the grooves can provide a suitable capillary action sufficient to form a uniform ink flow. However, it is especially desirable that the width of the groove is from 10 to 200 μm and the depth thereof is from 10 to 300 μm. Ejection electrodes 22*b* are provided in respective ones of the grooves 43. The ejection electrode 22*b* may be arranged so as to cover the entire surface of the ink groove 43 or it may be formed on only a portion of the groove using a conductive material such as aluminum, nickel, chromium, gold or platinum, according to a well-known method as described in the above-described example of the device. Additionally, the ejection electrodes are electrically isolated from one another. Two ink grooves adjacent to each other form one cell, and a separator wall 44 positioned in the center of the cell has an ejector 45 or 45' in the tip. The separator wall 44 is made thinner in the ejector 45 or 45' than in other portions thereof, and the ejector is sharpened. The main body of the head is formed by the configuration method such as mechanical processing or etching of a block of insulator material, or molding of an insulator material. It is desirable that the separator wall in the ejector has a thickness of from 5 to 100 μm and the sharpened tip thereof have a radius of curvature of from 5 to 50 μm. Further, the tip of the ejector may be slightly cut off as shown in the ejector 45'. In the figure, only two cells are recorded for ease of illustration. A separator wall 46 is disposed between cells. The tip 47 of the wall 46 is cut off so as to be set back compared with the ejectors 45 and 45'. The ink is flowed into the ejection head via ink grooves from the direction indicated by an arrow I with from an ink supplying device (not shown), and thereby supplied to the ejectors. Further, the excess ink is recovered in the direction indicated by an arrow O with an ink recoverer (not shown). As a result, fresh ink is always supplied to each ejector. A plate cylinder holding a plate material on the surface thereof (not shown) is arranged so as to face the ejector. While maintaining such a condition, a voltage corresponding to the image information is applied to the ejection electrode, and ink is ejected from the ejector to form an image on the plate material.

Still another example of the ejection head is described with reference to FIG. 9. As shown in FIG. 9, the ejection head 22 has a pair of nearly rectangular plate-shaped support members 50 and 50'. Each of these support members 50 and 50' is made of an insulating plastic, glass or ceramic plate having a thickness of from 1 to 10 mm, and in one surface thereof there are formed a plurality of rectangular grooves 51 or 51' (not shown) extending parallel to one another depending on the recording resolution. Each of the grooves 51 and 51' desirably has a width of from 10 to 200 μm and a depth of from 10 to 300 μm. In each of the grooves, an ejection electrode 22*b* is formed so as to cover the whole or only a portion of the groove surface. The formation of a plurality of grooves 51 or 51' in one surface of each support member 50 or 50' results in the formation of rectangular separator walls 52 between respective pairs of grooves 51. The support members 50 and 50' are placed together so that the surfaces thereof in which no grooves 51 are formed are brought into contact with each other. Specifically, the ejection head 22 has a plurality of grooves for distribution of ink over the periphery thereof. The grooves 51 formed in the support member 50 are coupled to corresponding ones of the grooves 51' formed in the support member 50' by way of the rectangular portion 54 of the ejection head 22. Each rectangular portion 54 that couples together two corresponding grooves is set back a predetermined distance (e.g., 50 to 500 μm ) from the top end portion 53 of the ejection head 22. In other words, each of the separator walls 52 adjoining each rectangular portion 54 on both sides is disposed so that the top end 55 of each separator wall 52 of each support member 50, 50' protrudes beyond the adjacent rectangular portions 54. In addition, a guide protrusion 56 made of an insulator material as described above is attached so as to protrude beyond each rectangular portion 54, thereby forming the ejector.

When ink is circulated through the ejection head 22 having the structure as described above, the ink is supplied to each rectangular portion 54 via a respective groove 51 formed at the periphery of the support member 50, and the ink is discharged via the grooves 51' formed in the support member 50' opposite the support member 50. In this case, the ejection head 22 is inclined at a predetermined angle to obtain the smooth ink distribution, In other words, the ejection head 22 is included so that the ink supply side (the support member 50) is situated upward and the ink discharge side (the support member 50') is situated downward. By circulating the ink through the ejection head 22 in such a manner, the ink passing across each rectangular portion 54 flows forward along the guide protrusions 56 to form an ink meniscus in the vicinity of the rectangular portion 54 and the protrusion 56. A plate cylinder holding a plate material on the surface thereof (not shown) is arranged so as to face the ejector. With independent ink meniscuses formed on the respective rectangular portions 54, a voltage corresponding to the image information is applied to the ejection electrode 22, and the ink is ejected from the ejector to form an image on the plate material. A cover may be attached along the periphery of each of the support members 50 and 50' to cover the grooves, thereby forming pipe-shaped ink flow courses along the periphery of each of the support members 50 and 50'. In such a case, since the ink can be made to circulate by way of these ink flow courses, it is not necessary to incline the ejection head 22.

The heads 22 as shown in FIGS. 3 to 9 can also be provided with a maintenance device such as a recording head cleaner if desired. For instance, in a case where recording has been suspended for a certain period or problems in image quality occur, a device for wiping the tip of the ejection head with a flexible brush or cloth, a device for circulating the ink solvent alone, a device for exerting suction on the ejector while supplying or circulating the ink solvent alone and the like can be adopted singly or in combination, whereby satisfactory recording conditions can be maintained. In order to prevent the ink from solidifying inside the ejection head, it is also effective to cool the ejection head, thereby reducing evaporation of the ink solvent. Further, if the contamination of the head is severe, a method of suctioning ink from the ejector, a method of blowing air in the ink flow course, and a method of applying ultrasonic waves to the head while immersing the head in an ink solvent are also effective. These methods can be used alone or in combination.

A specific example will be described hereinafter with reference to an on-press recording type multi-color single-sided lithographic printing apparatus.

FIG. 10 is a schematic diagram illustrating the entire configuration of an on-press recording type four-color lithographic printing apparatus. As shown in FIG. 10, the four-color single-sided printing apparatus essentially comprises four plate cylinders 11, four blanket cylinders 12 and four impression cylinders 13 of the monochromatic single-sided printing apparatus shown in FIG. 1 arranged for each of four colors such that printing is effected on the same surface of printing paper P. Though not shown, the delivery of printing paper from an impression cylinder to another as shown by K is carried out by a known delivery cylinder or the like. Although detailed description is omitted, as can be easily seen in the example of FIG. 10, other multi-color single-sided printing apparatus each essentially comprise a plurality of plate cylinders 11, blanket cylinders 12 and impression cylinders 13 arranged for each color such that printing is effected on the same surface of printing paper P. In the case where only one printing plate is prepared for each plate cylinder, there are provided plate cylinders and blanket cylinders in an amount corresponding to the number of colors to be printed. (Such a printing apparatus is referred to as "unit type printing apparatus"). On the other hand, in the case where the present invention is implied in the form of a common impression cylinder type printing apparatus which shares one impression cylinder having a diameter which is an integral multiple of the diameter of the plate cylinder among plate cylinders and blanket cylinders in an amount corresponding to the number of a plurality of colors, the arrangement may be such that one impression cylinder is shared by plate cylinders and blanket cylinders in an amount corresponding to the number of colors to be printed. Alternatively, the arrangement may be such that one impression cylinder is shared by plate cylinders and blanket cylinders in an amount corresponding the number of the plurality of colors, or the total number of plate cylinders and blanket cylinders corresponds to the number of colors to be printed. In this arrangement, the delivery of printing paper between adjoining common impression cylinders may be carried out by the foregoing known delivery cylinder or the like.

On the other hand, in the case where a plurality of color printing plates are prepared for each plate cylinder, plate cylinders and blanket cylinders are necessary in an amount corresponding to the value obtained by dividing the number of colors to be printed by the number of printing plates per plate cylinder. For example, when two color printing plates are prepared per plate cylinder, a press comprising two plate cylinders and two blanket cylinders can be used to effect four-color printing on one side of printing paper. In this case, the diameter of the impression cylinder is the same as that of the plate cylinder for one color. If necessary, the impression cylinder is provided with a means for holding printing paper until printing of the required number of colors is completed. The delivery of printing paper between impression cylinders can be accomplished by a known delivery cylinder method or the like. In the case of a press having two plate cylinders having the foregoing two color machine plates formed thereon and two blanket cylinders, when one of the two impression cylinders rotates twice holding printing paper, two-color printing is effected. Subsequently, printing paper is delivered between the impression cylinders. When the other impression cylinder rotates twice holding printing paper, another two-color printing is effected, thereby completing four-color printing. The number of impression cylinders to be installed may be the same as that of plate cylinders. Several plate cylinders and blanket cylinders may have one impression cylinder in common.

On the other hand, in the case where the present invention is implicated in the form of on-press recording type multi-color double-sided lithographic printing apparatus, a known printing paper inverting device is provided in at least one gap between adjacent impression cylinders in the foregoing unit type printing apparatus or in at least one gap between adjacent impression cylinders in an arrangement having a plurality of the foregoing common impression cylinder type printing apparatus. Alternatively, a plurality of the plate cylinders 11 and blanket cylinders 12 in the monochromatic single-sided printing apparatus shown in FIG. 1 are provided to effect printing on both surfaces of the printing paper. In the latter structure as shown in FIG. 1, in the case where only one color printing plate is prepared for each plate cylinder, there are provided plate cylinders and blanket cylinders in an amount corresponding to the number of colors to be printed on both surfaces of printing paper. On the other hand, in the case where a plurality of color printing plates are prepared for each plate cylinder as mentioned above, the required number of plate cylinders, blanket cylinders and impression cylinders can be reduced. Further, in the case where several plate cylinders and blanket cylinders have one impression cylinder in common, the required number of impression cylinders may be reduced, too. If desired, the plate cylinder is provided with a means for holding printing paper until the desired number of colors are printed. The detail of the configuration of this system can be easily inferred from the foregoing example of on-press recording type multi-color single-sided lithographic printing apparatus and thus will not be described hereinafter.

The embodiment of implication of the on-press recording type multi-color lithographic printing apparatus according to the present invention has been described with reference to an example of sheet-feed press. In the case where the present invention is implicated as an on-press recording type multi-color web (paper roll) lithographic printing machine, on the other hand, the foregoing unit type or common impression cylinder type printing machine can be used to advantage. In the case where the present invention is implicated as an on-press recording type multi-color web double-sided printing machine, both the unit type and common impression cylinder type printing machine can be realized by arranging a plurality of structures each having a known web inverting device provided in at least one gap between adjacent impression cylinders such that printing is effected on both surfaces of printing paper P. Most preferred among on-press recording type multi-color web double-sided printing apparatus is BB (blanket-to-blanket) type printing machine. This type of printing machine comprises one plate cylinder and blanket cylinder (no impression cylinder) for one color to be printed on one surface of web and one plate cylinder and blanket cylinder (no impression cylinder) for the same color to be printed on the other surface of web, said blanket cylinders being pressed against each other during printing. This structure is provided in an amount corresponding to the number of colors to be printed. Web passes through the gap between the blanket cylinders which are pressed against each other during printing to perform multi-color double-sided printing.

Another example of the on-press recording type lithographic printing apparatus has two plate cylinders per blanket cylinder, whereby printing is effected on one of the two plate cylinders while image recording is being effected on the other. In this case, it is desirable that the plate cylinder on the part of image recording be driven while being mechanically separated off from the blanket cylinder. In this manner, image recording is made possible without suspending the operation of the press. As can be easily inferred, this on-press recording type lithographic printing apparatus can be applied to on-press recording type multi-color single-sided lithographic printing apparatus and on-press recording type multi-color double-sided lithographic printing apparatus.

A description is given of a plate making method employing an ink jet recording method according to the invention.

Hereinafter, a configurational example is shown of the plate making apparatus that is used to embody the plate making method according to the invention.

FIG. 11A and FIG. 11B are general configurational views of the plate making apparatus. FIG. 2 is an outlined configuration example of a recording portion including a controller, an ink supplier, and a mechanism for moving a head toward or away in the plate making apparatus. Each of FIGS. 3 to FIG. 9 illustrates an ink jet recording device with which the plate making apparatus in FIG. 11A and FIG. 11B are provided.

In addition, as shown in FIG. 11A, a description is given of a plate making process according to the invention, using a general configurational view of a plate making apparatus having a structure in which a plate material is mounted on a recording drum 11. However, the present invention is not limited to the following example of construction.

The drum 11 is usually made of metal such as aluminum, stainless steel, iron, etc., plastic or glass. In particular, in the case where the drum 11 is a metallic cylinder, there are many cases where the surface thereof is subjected to, for example, alumite treatment and chrome plating to enhance its abrasion resistance and rust-proof property. The drum 11 may have a heat insulator material on the surface thereof as described later. In addition, it is favorable that the drum 11 is grounded because it acts as the counterelectrode to an electrode of the ejection head during ejection under an electrostatic field. On the other hand, where the substrate of a plate material is good insulator, it is preferable that a conductive layer is provided on the substrate. In this case, it is preferable that the conductive layer is provided with a grounding means. Further, even where a heat insulator material is provided on the drum 11 as described above, the recording is easily accomplished by providing the plate material with a grounding means. In this case, means having a conductive property such as a known brush, a plate spring, and a roller.

The plate making apparatus 1 also has an ink jet recording device 2 which ejects an oil-based ink onto the plate material 9 mounted on the drum 11 in accordance with image data transmitted from the image data calculation controlling unit 21 to thereby form an image on the plate material.

The plate making apparatus 1 further has a fixing device 5 for fixing the oil-based ink image formed on the plate material 9. As necessary, a plate surface oil-desensitizing device 6 may be installed for increasing the hydrophilic property of the surface of the plate material 9. The plate making apparatus 1 also has means 10 for removing dust present on the surface of the plate material 9 before and/or during the process of recording the image onto the plate material 9. Therefore, ink can be effectively prevented from being adhered onto the plate material 9 by or along dust placed between the head and the plate material during the making of a plate, and satisfactory plate making can be carried out. As the dust removing means 10, a contact method using such as a brush, a roller, etc., may be employed in addition to a conventional non-contact method such as a removing method by suction, blowing, and/or an electrostaticity. In the present invention, either an air suction method or air blowing method or a combination thereof may be preferably employed.

Further, an automatic plate material supplying device 7 that automatically supplies plate materials 9 onto the drum 11, and an automatic plate material discharging device 8 that automatically removes plate materials 9 from the drum 11 after image recording is completed may be installed. Where the automatic plate material supplying device 7 and automatic plate material discharging device 8 are used, the plate making operation can be further facilitated and the time required for the plate making can be shortened, wherein effects of the invention can be further enhanced.

A description is given of a printing plate making process by a plate making apparatus 1 with reference to FIG. 11A and partially by FIG. 2.

The plate material 9 is first mounted on the drum 11 by using the automatic plate material supplying device 7. At this time, the plate material 9 is brought into close contact with and fixed on the drum 11 by a well-known mechanical method such as a plate top/tail gripping device, an air suction device, etc., or a well-known electrostatic method, etc. Therefore, the tail end of the plate material 9 is prevented from flapping against, and bringing into contact with and thus damaging the ink jet recording device 2 during the process of recording the image thereon. Also, it is possible to prevent the plate material 9 from being brought into contact with the ink jet recording device 2 by using an arrangement which brings the plate material 9 into close contact with the drum 11 only in the neighborhood of the recording position of the ink jet recording device 2 at least during recording the image. In detail, for example, the arrangement may be hold-down rollers disposed on both upstream and downstream sides of the recording position on the drum 11. When not recording an image, it is preferable that the head is kept apart from the plate materials, whereby it is possible to effectively prevent the plate materials from being brought into contact with the ink jet recording device 2 and being thereby damaged.

The image data calculation controlling unit 21 receives image data from an image scanner, a magnetic disk unit, an image data transmission device, etc., decomposes the colors as necessary, and simultaneously calculates to divide the decomposed image into an adequate number of pixels and graduations. Further, it calculates the dot area percentage in order to dot an oil-based ink image or to make the same into half tone by using an ink jet ejection head 22 (See FIG. 3, described in detail later) that the ink jet recording device 2 has. In addition, as described later, the image data calculation controlling unit 21 controls movement of the ink jet ejection head 22 and ejection timing of oil-based ink, and simultaneously, controls the operation timing of the drum 11, etc., as necessary.

The calculation data that are inputted into the image data calculation controlling unit 21 are temporarily stored in a buffer.

The image data calculation controlling unit 21 instructs the rotation of the drum 11 and moves the ejection head 22 towards the drum 11 by the head approaching and separating device 31. The distance between the ejection head 22 and the surface of the plate material 9 mounted on the drum 11 is controlled at a predetermined distance during recording, by mechanical distance control such as contact rollers or by controlling the head approaching and separating device based on signals from an optical distance detector. With such distance control, the dot diameters are not made uneven due to floating of a plate material and also the dot diameters do not change even when vibration is given to the plate making apparatus. Thus, the satisfactory plate making can be carried out.

The main scanning is carried out by rotations of the drum 11 in order to record an image. The ejector is arrayed in the axial direction of the drum 11. The ejection head 22 is moved in the axial direction of the drum 11 per rotation of the drum 11 by the image data calculation controlling unit 21, wherein oil-based ink is ejected onto a plate material 9 mounted on the drum 11 at the ejection position and dot area percentage, which are obtained by the above-described calculation. Therefore, a dot (half-tone) image with gradations corresponding to the original print is recorded on the plate material 9 with oil-based ink. These operations are continued until the oil-based ink image corresponding to one-color information of the original print is formed on the plate material 9 to prepare a printing plate.

And, in order to protect the ejection head 22, the ejection head 22 is moved away from the position close to the drum 11. The head approaching and separating means operates so as to keep the ejection head at least 500 $\mu$m or more away from the drum except during image recording. The toward and away operation may be effected using sliding system, or mechanical by which the ejection head 22 is gripped with an arm fixed on a shaft and moved in a pendulum-like motion by operating the arm around the shaft. Since the ejection head 22 is thus moved array form the drum when the image recording is not carried out, the ejection head 22 is protected from any physical damage or contamination. As a result, the life of the head can be extended.

In addition, the formed oil-based ink image is hardened by the fixing device 5. As a fixing means of ink, a heat fixing means, and a solvent fixing means, which have been publicly known, may be used. It is general that, in the heat fixing means, an infrared ray lamp, a halogen lamp, or a xenon flash lamp is irradiated, or hot air is applied by a heater, or a heated roller is used. In such a case, for increasing the fixing efficiency measured made be adopted such as preheating the plate cylinder, preheating the plate material, performing the recording under exposure to hot air, using a plate cylinder coated with a heat insulator, or heating the plate material alone by separating the plate material from the plate cylinder only at the time of fixing. Flash fixing using, e.g., a xenon lamp, is well-known as a fixing method for electrophotographic toner, and has the advantage of performing the fixing in a short time. In addition, where a paper plate material is used, a phenomenon called "blister", in which humidity inside the plate material is sharply vaporized due to a sharp increase in temperature, and the surface of the plate material is made convex and concave, is obliged to occur. It is preferable that, in order to gradually raise the temperature of the plate material, the power supply to a heating source is gradually increased while rotating the drum 11, and the rotation speed is varied from high speed to low speed with the power supply made constant. It is also preferable that a plurality of fixing devices are installed in the rotation direction of the drum 11, the temperature of paper plate materials is gradually increased by varying the distance to these plate materials 9 and/or the supply power.

In the case of solvent fixing, a solvent capable of dissolving the resin component of the ink, such as methanol and ethyl acetate, is sprayed or its vapor exposes onto the plate material, and the excess solvent vapor is recovered.

Also, at least in the process from formation of an oil-based ink image, which is made by the ejection head 22, to a fixing made by a fixing device 5, it is highly recommended that nothing is brought into contact with the image on the plate material 9.

In addition, a description with reference to FIG. 2 is given of a configurational example of a plate making device in which subscanning is carried out by running the plate material 9. However, the present invention is not limited to the following construction.

The plate material 9 is pinched and held by two pairs of capstan rollers 12. An image is recorded by the ink jet recording device 2 using data that are calculated to be divided into adequate numbers of pixels and graduations by the image data calculation controlling unit 21. It is preferable that a grounding means 13 which becomes the counterelectrode to an electrode of the ejection head during ejection under an electrostatic field is provided at the portion to be recorded by the ink jet recording device 2, wherein the recording is facilitated.

On the other hand, a conductive layer is preferably provided on a substrate where the substrate of a plate material 9 is good insulator. In this case, the conductive layer is preferably grounded by a publicly known means such as a brush, a plate spring, a roller or the like, which has a conductive property.

In addition, FIG. 11B shows a device in which a sheet plate material is used. However, a roll-shaped plate material may be favorably used. In this case, it is preferable that a sheet cutter is provided at the upstream side of an automatic plate, material discharging device.

Further, the plate making apparatus has an ink jet recording device 2, whereby, in order to form an image, oil-based ink is ejected into the plate material 9 in response to image data that are sent from the image data calculation controlling unit 21.

In addition, the plate making apparatus 1 has a fixing device 5 for fixing an oil-based ink image recorded on the plate material 9. As necessary, a plate surface oil-desensitizing device 6 may be installed for increasing the hydrophilic property of the surface of the plate material 9. The plate making apparatus 1 also has means 10 for removing dust present on the surface of the plate material 9 before and/or during the process of recording the image onto the plate material 9. Therefore, ink can be effectively prevented from being adhered onto the plate material 9 by or along dust placed between the ejection head and the plate material during the making of a plate, and satisfactory plate making can be carried out. As the dust removing means 10, a contact method using such as a brush, a roller, etc., may be employed in addition to a conventional non-contact method such as a removing method by suction, blowing, and/or an electrostaticity. In the present invention, either an air suction method or air blowing method or a combination thereof may be preferably employed.

Further, an automatic plate material supplying device 7 that automatically supplies plate materials 9 onto the drum 11, and an automatic plate material discharging device 8 that automatically removes plate materials 9 from the drum 11 after image recording is completed may be installed. Where the automatic plate material supplying device 7 and automatic plate material discharging device 8 are used, the plate making operation can be further facilitated and the time required for the plate making can be shortened, wherein effects of the invention can be further enhanced.

A description is given of a printing plate making process by a plate making apparatus 1 with reference to FIG. 11B and partially by FIG. 2.

First, the plate material 9 is delivered by using the automatic plate material supplying device 7 and capstan rollers 12. At this time, by providing a plate material guiding means (not illustrated) or the like as necessary, it is possible to prevent the plate material 9 from being damaged due to the top and tail end thereof flapping and being brought into contact with the ink jet recording device 2. In addition, a means for preventing the plate material 9 from slackening only at the neighborhood of the recording position of the ink jet recording device 2 is provided. Thus, it is possible to prevent the plate material 9 from being brought into contact with the ink jet recording device 2 by actuating the means at least during recording an image. In detail, for example, there is a means for providing hold-down rollers at the upstream and downstream sides of the recording position. When not recording an image, it is preferable that the ejection head is kept apart from the plate material 9, whereby it is possible to effectively prevent a poor condition such as a damage from occurring due to the ejection head being brought into contact with the ink jet recording device 2.

Image data from the magnetic disk device or the like are given to the image data calculation controlling unit 21, and the image data calculation controlling unit 21 calculates the ejection position of oil-based ink and dot area percentage at the position on the basis of the inputted image data. These calculation data are temporarily stored in a buffer.

The image data calculation controlling unit 21 controls movement of the ejection head 22, ejection timing of oil-based ink, and simultaneously, controls operation timing of the capstan rollers. As necessary, by the head approaching and separating device 31, the controlling unit 21 moves the ejection head 22 towards a position close to the plate material 9.

The distance-between the ejection head 22 and the surface of the plate material 9 is kept at a predetermined distance, during recording, by mechanical distance control such as contact rollers or by controlling the head approaching and separating device based on signals from an optical distance detector. With such distance control, the dot-diameters are not-made uneven due to floating of a plate material and also the dot diameters do not change even when vibration is given to the plate making apparatus. Thus, the satisfactory plate making can be carried out.

A single channel head, a multi-channel head, or a full-line head may be used as the ejection head 22, and subscanning is carried out by delivery of the plate material 9. In the case of the multi-channel head provided with a plurality of ejectors, the arraying direction of the ejectors is established to be roughly parallel to the traveling direction of the plate materials. In addition, in the case of the single channel head or multi-channel head, the ejection head 22 is moved orthogonally to the traveling direction of the plate material 9 per delivery of the plate material by the image data calculation controlling unit 21, and oil-based ink is ejected onto the plate material 9 on the basis of the ejection position and dot area percentage, which are obtained by the above-described calculation. Therefore, a dot (half-tone) image with gradation corresponding to the original print is recorded on the plate material 9 with oil-based ink. This operation is continued until the oil-based ink image corresponding to one-color information of the original print is formed on the plate material 9 to prepare a printing plate. On the other hand, where the ejection head 22 is a full-line head having the same length as that of the width of the plate material 9, the ejector is arrayed in the direction roughly orthogonal to the traveling direction of the plate material, and an oil-based ink image corresponding to one-color information of the original print is formed on the plate material 9 by the plate material 9 having passed through the recording portion to prepare a printing plate.

And, in order to protect the ejection head 22, the ejection head 22 is move away from the position close to the drum 11. The head approaching and separating means operates so as to keep the ejection head at least 500 $\mu$m or more away from the drum except during the image recording. The toward and away operation may be effected using sliding system, or mechanical by which the ejection head 22 is gripped with an arm fixed on a shaft and moved in a pendulum-like motion by operating the arm around the shaft. Since the ejection head 22 is thus moved away from the drum when the image recording is not carried out, the ejection head is protected from any physical damage or contamination. As a result, the life of the head can be extended.

In addition, the formed oil-based ink image is hardened by a fixing device 5. As a fixing means of ink, a heat fixing means, and a solvent fixing means, which have been publicly known, may be used. It is common that, in the heat fixing means, an infrared lamp, a halogen lamp, or a xenon flash lamp is irradiated or hot air is applied by a heater, or heated roller is used. Flash fixing using, e.g., a xenon lamp, is well-known as a fixing method for, electrophotographic toner, and has the advantage of performing the fixing in a short time. In addition, where a paper plate material is used, a phenomenon called "blister", in which humidity inside the paper plate material is sharply vaporized due to a sharp increase in temperature, and the surface of the plate material is made convex and concave, is obliged to occur. It is preferable that, in order to gradually raise the temperature of the paper plate material, in view of preventing the blister of the plate materials 9, a plurality of fixing devices are installed, the power supply and/or distance from the fixing devices to the plate material 9 is varied With respect to fixation by the solvent, a solvent that is capable of dissolving resin constituents in the ink such as methanol, ethyl acetate, etc., is sprayed, or the plate material is exposed to vapor thereof, and surplus solvent vapor is collected.

Also, at least in the process from formation of an oil-based ink image, which is made by the ejection head 22, to a fixing made by a fixing device 5, it is highly recommended that nothing is brought into contact with the image on the plate material 9.

The obtained printing plate is subjected to printing by a publicly known lithographic printing method. That is, printing corresponding to one color is carried out in the following steps, in which the printing plate on which an oil-based ink image is formed is mounted on a printing press, a printing ink image is formed by applying printing ink and dampening water, and is transferred onto a blanket cylinder that rotates together with a plate cylinder, and the printing ink image on the blanket cylinder is transferred onto sheets of paper that pass between the blanket cylinder and the impression cylinder. After the printing is completed, the printing plate is removed from the plate cylinder, and the blanket of the blanket cylinder is washed off by a blanket cleaning device, and subsequent printing is acceptable.

Also, since the ink jet recording device 2 is similar to that described with reference to FIG. 2 described above, description thereof is omitted.

A description is given of a printing method using an ink jet recording method according to the invention.

A configurational example of a printing apparatus used to embody the ink jet printing method according to the invention is shown below. However, the present invention is not limited to the following construction example.

FIG. 14 through FIG. 21 are views showing outlined configurational examples of a printing apparatus that records an image by moving a printing medium by rotations of an opposed drum according to the invention.

Figure 14:
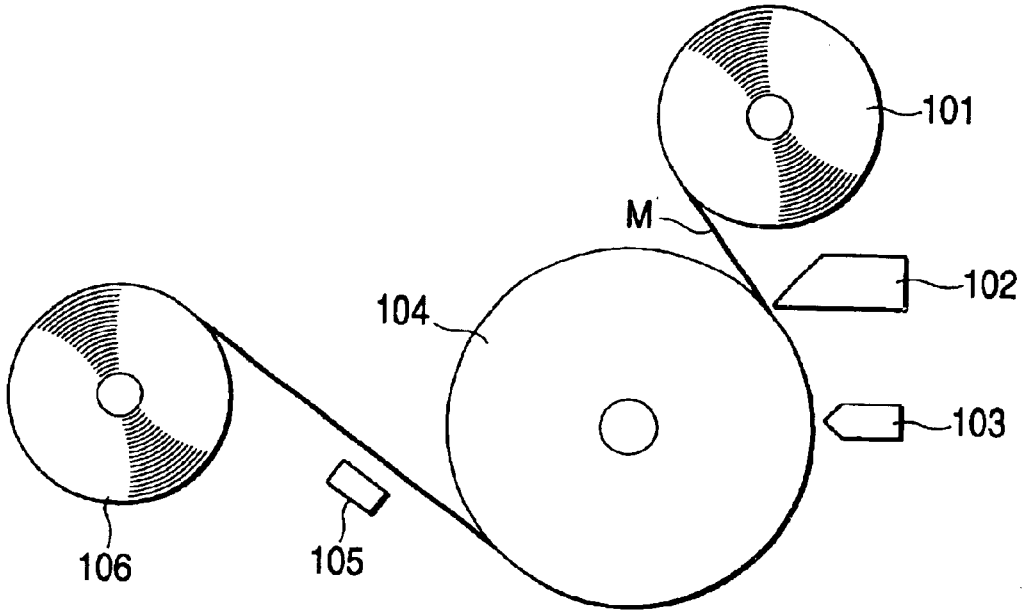
FIG. 14 is a general configurational view typically showing a web type apparatus carrying out single-sided monochromatic printing, which is an example of an ink jet printing apparatus according to the present invention.
Figure 15:
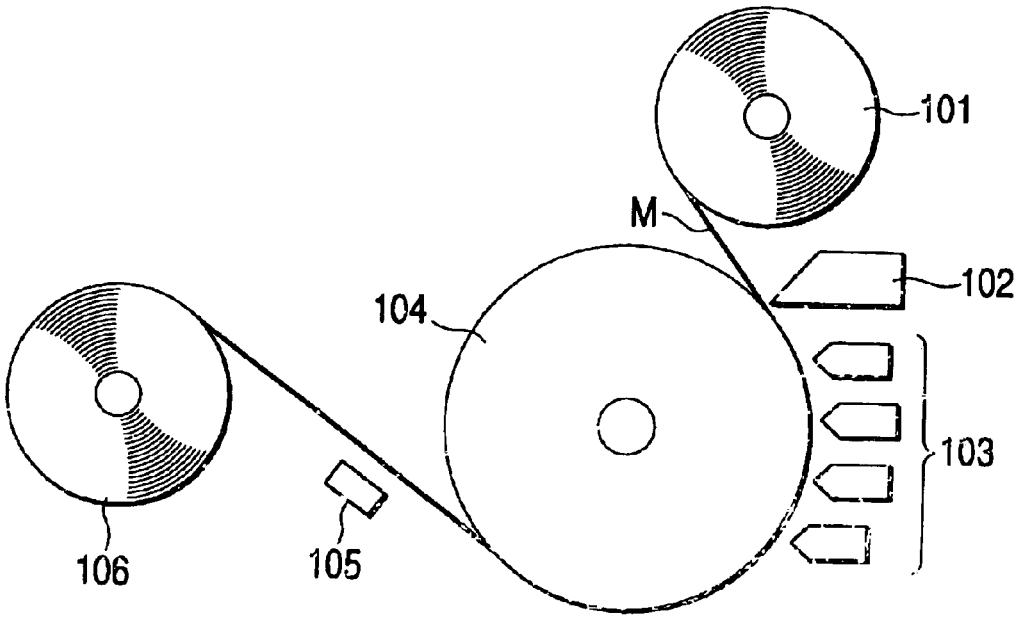
FIG. 15 is a general configurational view typically showing a web type apparatus carrying out single-sided four-color printing, which is another example of the ink jet printing apparatus according to the present invention.
Figure 16:
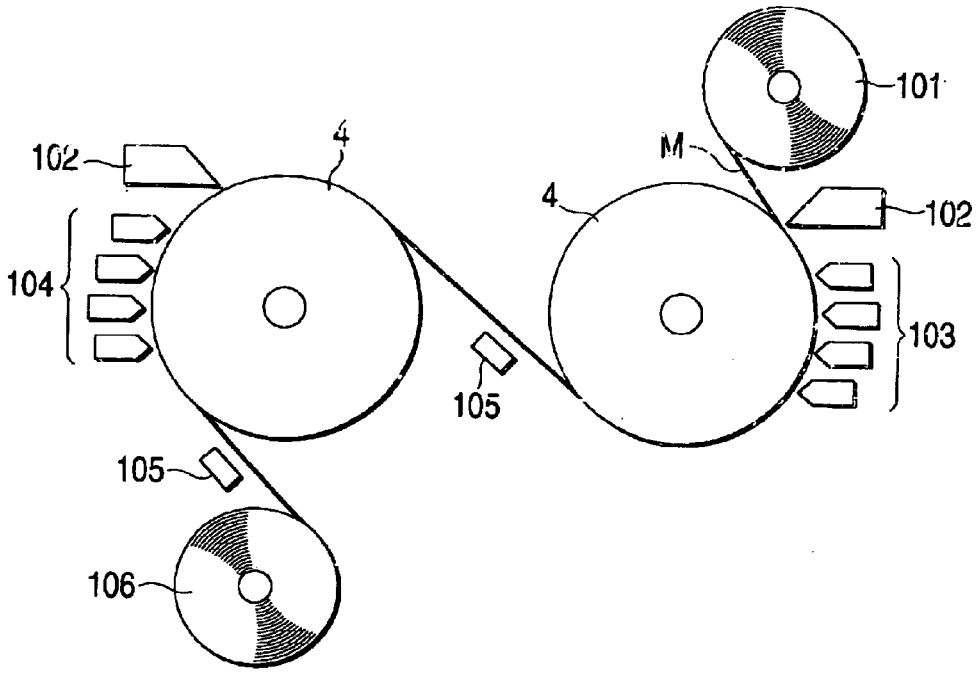
FIG. 16 is a general configurational view typically showing a double-sided four-color printing apparatus, which is still another example of the ink jet printing apparatus according to the invention.
Figure 17:
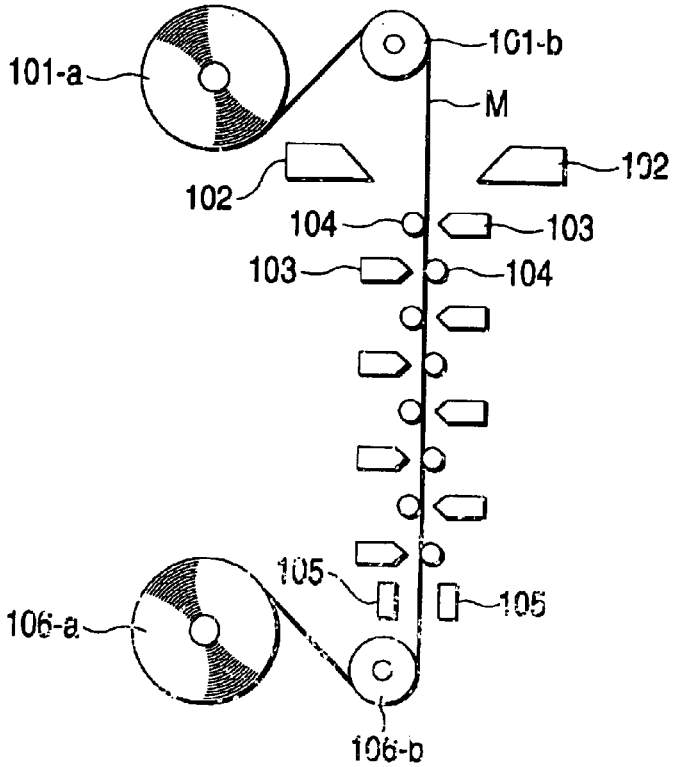
FIG. 17 is a general configurational view typically showing a double-sided four-color printing apparatus, which is still another example of the ink jet printing apparatus according to the invention.

FIG. 14 through FIG. 17 are views showing outlined configurational examples of a web type printing apparatus in which a roll-shaped printing medium is extended by a drum opposed thereto, a printing medium supplying roll and a printing medium winding roll or a guide roll. FIG. 14 shows a web type apparatus for carrying out single-sided monochromatic printing, and FIG. 15 shows a web type apparatus for carrying out single-sided four-color printing, FIG. 16 and FIG. 17 are views showing an outlined configurational example of a double-sided four-color printing apparatus.

Figure 18:
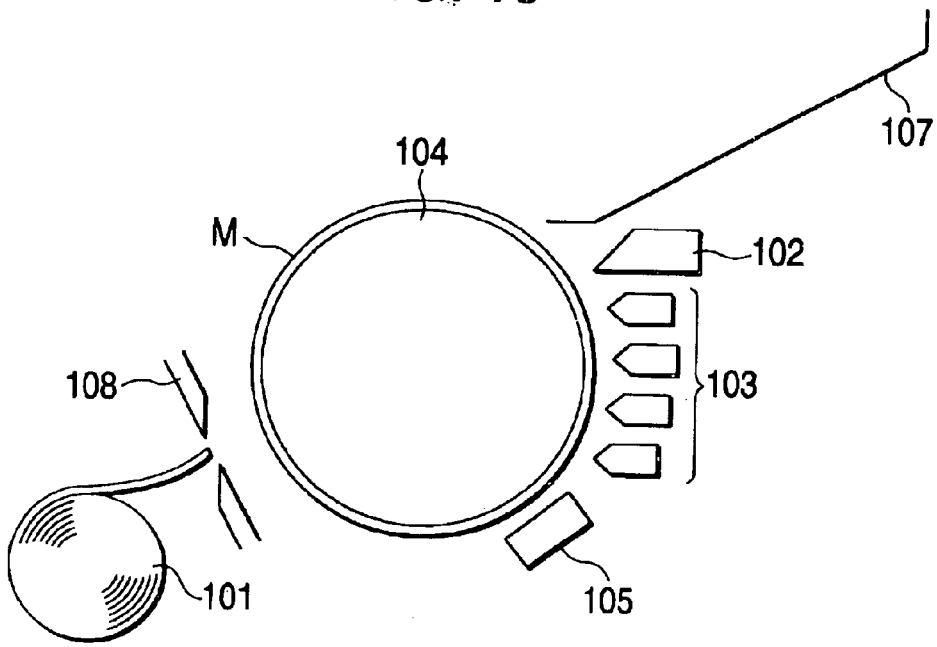
FIG. 18 is a general configurational view typically showing a single-sided four-color printing apparatus and a double-sided four-color printing apparatus for cutting a roll-shaped printing medium and winding on the opposed drum to print thereon, which is still another example of the ink jet printing apparatus according to the invention.
Figure 19:
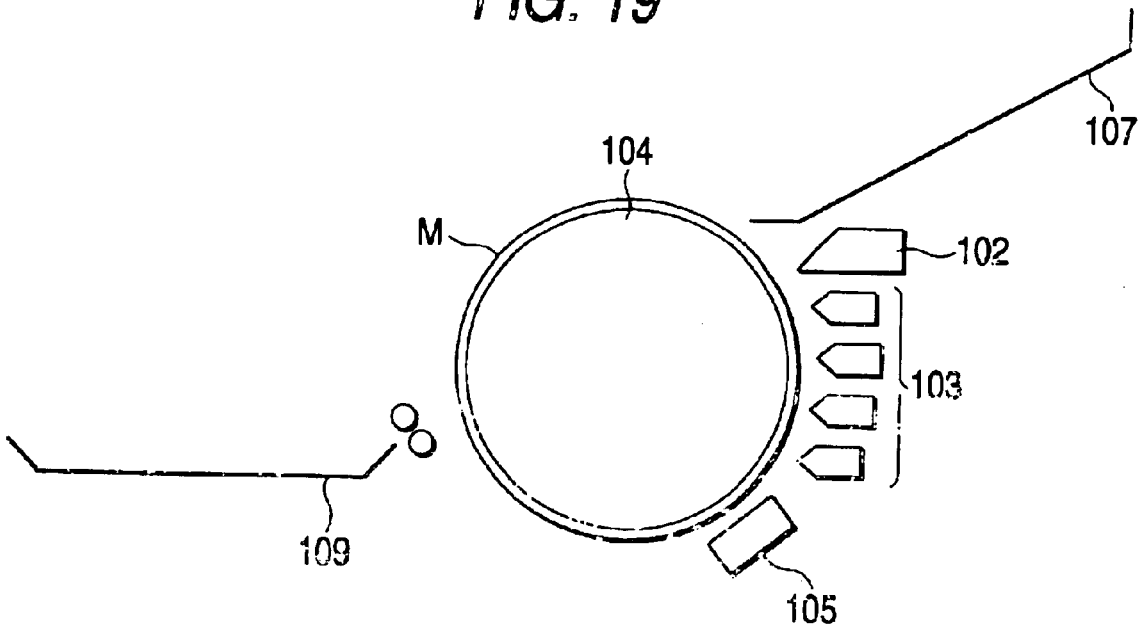
FIG. 19 is a general configurational view typically showing a printing apparatus employing sheet-shaped recording medium, which is still another example of the ink jet printing apparatus according to the invention.

Also, FIG. 18 is a view showing an outlined configurational example of a single-sided four-color printing apparatus that cuts a roll-shaped printing medium, winds a cut printing medium on a drum opposed thereto, and carries out printing. FIG. 19 is a view showing an outlined configurational example of a printing apparatus using a sheet-shaped recording medium.

Figure 20:
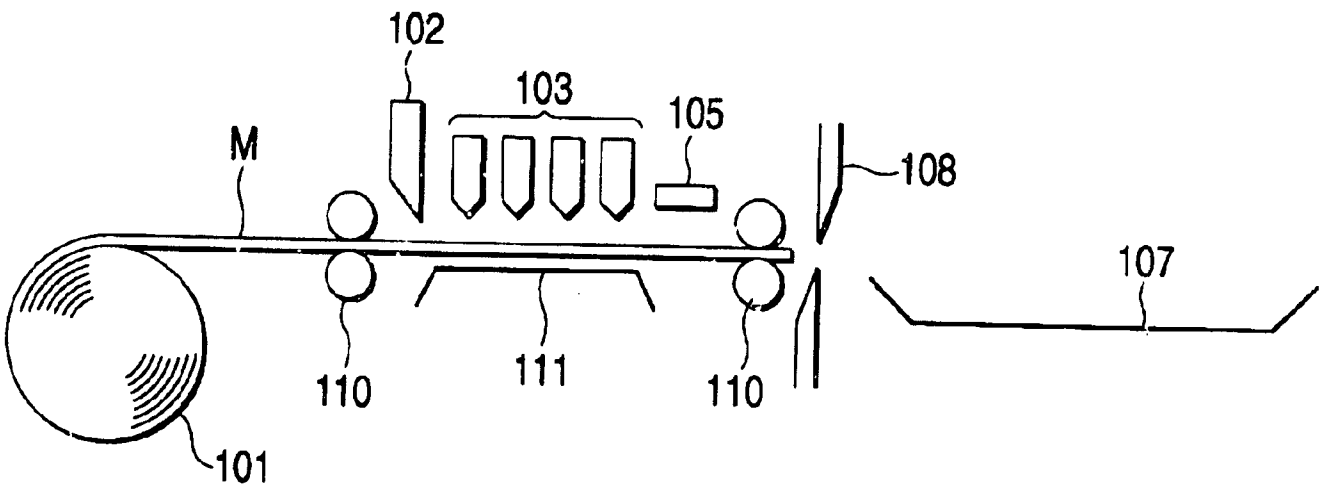
FIG. 20 is a general configurational view typically showing a printing apparatus for recording the image by running a roll-shaped printing medium with the same pinched by capstan rollers, which is still another example of the ink jet printing apparatus according to the invention.
Figure 21:
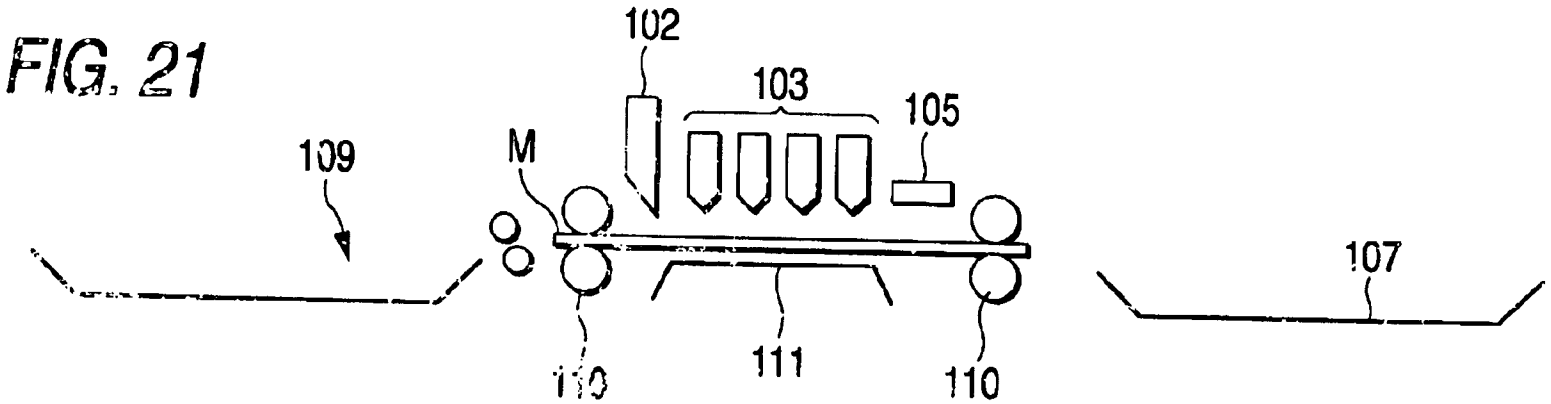
FIG. 21 is a general configurational view typically showing a printing apparatus for recording the image by running a sheet-shaped printing medium with the same pinched by capstan rollers, which is still another example of the ink jet printing apparatus according to the invention.

On the other hand, FIG. 20 and FIG. 21 are views showing an outlined configurational example of a printing apparatus that records an image by running a printing medium with the same pinched between the capstan rollers according to the invention. Of the drawings, FIG. 20 shows a printing apparatus employing a roll-shaped printing medium, and FIG. 21 shows a printing apparatus employing a sheet-like recording medium.

First, a description is given of a printing process according to the invention, using a general configurational view with respect to an apparatus that carries out single-sided one-color printing on the roll-shaped printing medium shown in FIG. 14.

An ink jet printing apparatus (hereinafter called a "printing apparatus") shown in FIG. 14 is composed of a supplying roll 101 of a roll-shaped printing medium, a dust and paper dust removing device 102, a recording device 103, an opposed (image-recording) drum disposed at a position opposed to the recording device 103 and a printing medium, a fixing device 105 and a printing medium winding roll 106.

After dust on the printing medium, which is sent out from the supplying roll is removed by the dust and paper dust removing device 102, ink is ejected from an ink ejector (described later) of the recording device 103 onto a printing medium on the recording drum 104 in compliance with an image, and a printing image is recorded. After the image is fixed on the printing medium by using the fixing device 105, the printed medium is wound on the printing medium winding roll 106.

The opposed (image recording) drum 104 may be a metallic roll that is made into an counterelectrode with respect to the ejection electrode of the ink ejector, or a roll having a conductive rubber layer formed on the surface thereof, or such that a metallic layer is deposited or plated on an insulation drum surface made of plastic, glass or ceramic, etc. Therefore, an effective electric field may be formed between the drum and the ejector of the recording device 103. Also, a heating means is provided on the recording drum 104 to increase the drum temperature, whereby the image recording quality may be improved, and blurring of ink can be further suppressed rather than fostering a rapid fixing of the ejected ink drops on the printing medium.

Further, the physical values of the ink drops ejected on the printing medium are controlled with the drum temperature kept constant, wherein it is possible to uniformly form stabilized dots. It is preferable that a cooling means is provided to make the drum temperature uniform.

As a means for removing dust and paper dusts, publicly known methods that are a non-contact type method such as a suction-removing method, a blow-removing method, or an electrostatic removing method, and a contacting type method using a brush, a roller, etc., may be used.

In the invention, either one or a combination of an air suction method or an air blowing method is used.

In addition, the recording device 103 has an ink jet recording device 2 as shown in FIG. 2. The description of the ink jet recording device is as described above, and description thereof is omitted.

Referring to FIG. 14 and FIG. 2, a detailed description is given below of a printing process that is carried out by the printing apparatus.

A printing medium sent out from the printing medium supplying roll is given tension by drive of the printing medium winding roll, and is brought into contact with the recording drum opposed thereto, whereby a printing medium web is vibrated, and it is possible to prevent the printing medium from being brought into contact with the ink jet recording device and being thereby damaged when recording an image.

In addition, a means for adhering a printing medium onto the recording drum opposed thereto is provided only at the surrounding of the recording position of the ink jet recording device, wherein by actuating the means at least when recording an image, it is possible to prevent the printing medium from being brought into contact with the ink jet recording device. In detail, for example, it is effective that hold-down rollers are provided at the upstream side and downstream side of the recording position of the recording drum, or a guide or electrostatic suction is utilized.

The image data from a magnetic disk device, etc., are given to the image data calculation controlling unit 21, and the image data calculation controlling unit 21 carries out calculations regarding the ejection position of oil-based ink in response to the inputted image data, and a dot area percentage at the position. These calculated data are temporarily stored in a buffer. The image data calculation controlling unit 21 moves the ejection head 22 towards the position close to the printing medium in contact with the recording drum, by the head approaching and separating device 31. The distance between the ejection head 22 and the surface of the recording drum is maintained at a predetermined distance during recording by a mechanical distance control such as contact rollers or by controlling the head approaching and separating device on the basis of signals from an optical distance detector. The ejector is arrayed in roughly parallel to the traveling direction of a printing medium, wherein, in order to perform printing, the main scanning is carried out by movement of the ejection head in the axial direction of the above-described opposed drum and subscanning is carried out by rotation of the above-described opposed drum. The movement control of the above-described opposed drum and ejection head is carried out by the image data calculation controlling unit 21. The ejection head ejects oil-based ink onto a printing medium at the ejection position and dot area percentage, which are obtained by the above-described calculations. Thus, a dot image with gradations corresponding to the original print is recorded with oil-based ink. The movement is continued until a predetermined ink image is formed on the printing medium.

After the printing is completed, the ejection head 22 is retreated, in order to protect the ejection head 22, so that it is kept apart from the position close to the recording drum as necessary. At this time, although only the ejection head 22 may be separated, the ejection head 22 and ink supplier 24 may be separated together.

And, the head approaching and separating means operates so as to keep the recording head at least 500 $\mu$m or more away from the recording drum except during the image recording. The toward and away operation may be effected using sliding system, or mechanical by which the head is gripped with an arm fixed on a shaft and moved in a pendulum-like motion by operating the arm around the shaft. Since the head is thus moved away from the drum when image recording is not being carried out, the head is protected from any physical damage or contamination. As a result, the life of the head can be extended.

In addition, the formed oil-based ink image is hardened by a fixing device 105. As a fixing means of ink, a heat fixing means, and a solvent fixing means, which have been publicly known, may be used. It is common that, in the heat fixing means, an infrared lamp, a halogen lamp, or a xenon flash lamp is irradiated, or hot air is applied by a heater, or a heated roller is used. Flash fixing using, e.g., a xenon lamp, is well-known as a fixing method for electrophotographic toner, and has the advantage of performing the fixing in a short time. In addition, where a laminated paper material is used, since a phenomenon called "blister", in which humidity inside the paper plate material is sharply vaporized due to a sharp increase in temperature, and the surface of the paper plate material is made convex and concave, is obliged to occur. Therefore, in order to gradually raise the temperature of the paper plate material, in view of preventing the blister, it is preferable that a plurality of fixing devices are installed, the power supply and/or distance to the fixing devices is varied.

With respect to fixation by the solvent, a solvent that is capable of dissolving resin constituents in the ink such as methanol, ethyl acetate, etc., is sprayed, or the plate material is exposed to vapor thereof, and surplus solvent vapor is collected. Also, at least in the process from formation of an oil-based ink image, which is made by the ejection head 22, to a fixing made by a fixing device 105, it is highly recommended that nothing is brought into contact with the image on the plate material 9.

FIG. 15 through FIG. 17 show configurational examples of a single-sided four-color printing apparatus and a double-sided four-color printing apparatus. However, since the operation principle thereof can be easily understood on the basis of the description of the above-described single-sided monochromatic printing apparatus, description thereof is omitted.

In addition, herein, the construction example of the four-color printing apparatus is shown. The invention is not limited thereto, wherein the number of colors may be optionally determined as necessary.

FIG. 18 and FIG. 19 show other configurational examples according to the invention. The drawings are views of a printing apparatus that is provided with an automatic taking-off device 107 and is used with a printing medium wound on the opposed drum. FIG. 19 shows a configurational example of an apparatus using a sheet-shaped printing medium, which is provided with an automatic supplying device 109. Herein, a description is given of the configurational example in which an apparatus employing a roll-shaped printing medium of FIG. 18 is used.

First, a printing medium that is drawn out from the printing medium supplying roll 101 and is cut to an optional size by a cutter 8 is mounted on the opposed drum. At this time, the printing medium is brought into close contact with and fixed on the drum by a mechanical method such as a sheet top/tail gripping device, an air suction device, etc., or an electrostatic method, etc., which have been publicly known, whereby it is possible to prevent the printing medium from being damaged due to the tail end thereof flapping and contacting the ink ejection recording device 103 when recording an image-thereon.

Also, a means that adheres the printing medium to the drum only at the neighborhood of the recording position of the ink jet recording device is provided, and it is possible to prevent the printing medium from being brought into contact with the ink jet recording device by actuating the means at least when recording an image. In detail, for example, there is a means for providing hold-down rollers at the upstream and downstream sides of the recording position on the opposed drum.

Further, when not recording an image, it is preferable that the head is kept apart from the printing medium, whereby it is possible to effectively prevent the printing medium from being brought into contact with the ink jet recording device and being thereby damaged.

The main scanning is carried out by rotations of the opposed drum 104. The ejector is arrayed in the axial direction of the opposed drum 104.

The head 22 is continuously or subsequently moved in the axial direction by the image data calculation controlling unit 21, and oil-based ink is ejected onto the printing medium, which is mounted on the drum 11, at the ejection position and dot area percentage that are obtained from the calculations made by the image data calculation controlling unit 21. Thereby, on the printing medium, a dot image with gradation corresponding to the original print is recorded with oil-based ink. The operation is continued until a predetermined oil-based ink image is formed on the printing medium.

Herein, although a constructional example of a single-sided four-color printing apparatus is shown, the present invention is not limited to this. The construction thereof may be optionally determined, as necessary, in compliance with the number of colors, a single-sided or double-sided printing, etc.

On the other hand, FIG. 20 and FIG. 21 are views showing an outlined configurational example of a printing apparatus according to the invention, in which recording is carried out by causing a printing medium to travel with the same medium pinched by capstan rollers. FIG. 20 is an outlined configurational view of a printing apparatus in which a roll-shaped printing medium is used, and FIG. 21 is that of a printing apparatus in which a sheet-shaped printing medium is used.

Herein, a description is given with reference to the general configurational view of an apparatus in which single-sided four-color printing is executed on a roll-shaped printing medium shown in FIG. 20. A printing medium M is pinched by two pairs of capstan rollers 110 and is transferred, and an image is recorded by an ink ejection recording device 103, using the data that are calculated so as to be divided into adequate numbers of pixels and graduations by the image data calculation controlling unit (21 in FIG. 2). It is preferable that a grounding means 111 which becomes an counterelectrode to an electrode of the ejection head is provided during ejection under an electrostatic field, whereby the recording can be facilitated.

In addition, in FIG. 20, the printing apparatus is provided with a sheet cutter 108 for cutting the roll-shaped printing medium at the upstream side of the automatic delivery device 107. However, the sheet cutter may be disposed at any optional position.

Next, with reference to FIG. 20, a detailed description is given below of a process for producing print by a printing apparatus according to the invention.

First, a printing medium is transferred by using the capstan rollers 110. At this time, by providing a printing medium guiding means (not illustrated) as necessary, it is possible to prevent the printing medium from being brought into contact with the ink ejection recording device 103 and being damaged due to flapping of the top and tail of the printing medium. Also, a means is provided so that the printing medium is not slackened at the surrounding of the recording position of the ink ejection recording device, and if the means is actuated at least when recording an image, it is possible to prevent the printing medium from being brought into contact with the ink ejection recording device. In detail, there is a method for providing hold-down rollers, for example, at the upstream and downstream sides of the recording position.

Further, when not recording any image, it is highly recommended that the head is kept apart from the printing medium, whereby it is possible to effectively prevent the ink ejection recording device from being subjected to damage due to contacting.

The image data from a magnetic disk device, etc., are provided to the image data calculation controlling unit 21 in FIG. 2, and the image data calculation controlling unit 21 carries out calculations regarding the ejection position of oil-based ink and the dot area percentage at the position in response to the inputted image data. These calculation data are temporarily stored in a buffer.

The image data calculation controlling unit 21 controls movement of the ink jet head 22, ejection timing of oil-based ink, operation timing of the capstan rollers, and simultaneously, moves the ejection head 22 towards to the position close to the printing medium by the head approaching and separating device 31. The distance between the ejection head 22 and the surface of the printing medium is maintained at a predetermined distance during recording, by a mechanical distance control such as contact rollers, by controlling the head approaching and separating device on the basis of signals from an optical distance detector. With such distance control, the dot diameters are not made uneven due to floating of a plate material and also the dot diameters do not change even when vibration is given to the plate making apparatus. Thus, the satisfactory plate making can be carried out.

The subscanning is carried out by transfer of the printing medium. The ejector is arrayed roughly parallel to the traveling direction of the printing medium. The head 22 is moved in the direction orthogonal to the traveling direction of the printing medium by the image data calculation controlling unit 21, wherein oil-based ink is ejected at the ejection position and dot area percentage, which are obtained from the above-described calculations. Therefore, a dot image with gradation corresponding to the original print is recorded with oil-based ink. This operation is continued until a predetermined oil-based ink image is formed on the printing medium. The image printed on the printing medium is fixed by the fixing device 5 and is delivered by the automatic delivery device.

Herein, although the configurational example of the single-sided four-color printing apparatus is shown, the present invention is not limited to this. It is possible to optionally determine the number of colors, and a single-sided or double-sided printing as necessary.

In addition, the ink ejection recording device has been already described above with reference to FIG. 2. Herein, the description is omitted.

The plate material (printing original plate) which can be used in the present invention will be described in greater detail below.

As the printing original plate, there may be used a metal plate such as aluminum- or chromium-plated steel plate. In particular, an aluminum plate, which can be grained or anodized to have an excellent surface water retention and abrasion resistance, is desirable. As a more inexpensive plate material, there may be used a plate material having a water-resistant support such as paper subjected to a water-resistant treatment, a plastic film or paper laminated with plastic, having provided thereon an image-receiving layer. The thickness of the image-receiving layer is ordinarily in a range of from 5 to 30 $\mu$m.

The image-receiving layer includes a hydrophilic layer including an inorganic pigment and a binder and a layer capable of being rendered hydrophilic by an oil-desensitizing treatment.

The inorganic pigment used in the hydrophilic image-receiving layer includes clay, silica, calcium carbonate, zinc oxide, aluminum oxide and barium sulfate. The binder used includes a hydrophilic binder, for example, polyvinyl alcohol, starch, carboxymethyl cellulose, hydroxyethyl cellulose, casein, gelatin, a salt of polyacrylic acid, polyvinyl pyrrolidone and a methyl ether-maleic anhydride copolymer. Further, in order to impart water-resistance to the image-receiving layer, a melamine formaldehyde resin, a urea formaldehyde resin or other crosslinking agents may be added thereto if desired.

The image-receiving layer to which an oil-desensitizing treatment is applied includes, for example, a layer containing zinc oxide and a hydrophobic binder.

The zinc oxide according to the present invention is any of zinc oxide, zinc white, wet-type zinc white, and activated zinc white as commercially available, as described in Nippon Ganryo Gijutsu Kyokai, ed., "Shinban Ganryo Binran (New Edition of Pigment Handbook)", pp. 319, Kabushiki Kaisha Seiundo (1968).

Specifically, depending on the starting materials and production method, zinc oxide is classified into two groups, that produced by a wet method and that produced by a dry method, which groups are further subclassified into zinc oxide produced by the "French" method (indirect method) or "American" method (direct method). Suitable examples of zinc oxide include those commercially available from Seido Kagaku Kogyo K.K., Sakai Chemical Industry Co., Ltd., Hakusui Chemical Industries, Ltd., Honjo Chemical K.K., Toho Zinc Co., Ltd., and Mitsui Mining & Smelting Co., Ltd.

Specific examples of the resin to be used as binder include styrene copolymer, methacrylate copolymer, acrylate copolymer, vinyl acetate copolymer, polyvinyl butyral, alkyd resin, epoxy resin, epoxyester resin, polyester resin, and polyurethane resin. The resins may be employed singly or in combination of two or more thereof.

The content of the resin in the image-receiving layer is from 9/91 to 20/80 in terms of a weight ratio of resin/zinc oxide.

Examples of the oil-desensitizing solution which has heretofore been used for the oil-desensitizing of the image-receiving layer containing zinc oxide include those conventionally known, for example, a treating solution containing a cyan compound such as ferrocyanate or ferricyanate as the main component, a cyan-free treating solution containing an ammine cobalt complex, phytic acid or a derivative thereof, or a guanidine derivative as the main component, a treating solution containing an inorganic or organic acid capable of forming a chelate with an zinc ion as the main component, and a treating solution containing a water-soluble polymer.

For instance, treating solutions containing a cyan compound include those described, e.g., in Japanese Patent Examined Publication No. sho. 44-9045, Japanese Patent Examined Publication No. sho. 46-39403, Japanese Patent Unexamined Publication No. sho. 52-76101, Japanese Patent Unexamined Publication No. sho.57-107889 and Japanese Patent Unexamined Publication No. sho.54-117201.

It is preferable that the Beck's smoothness of the surface opposed to the image receiving layer of a plate material is in a range of 150through 700 (second/10 cc), whereby the formed printing plate is prevented from sliding or slipping during the printing on the plate cylinder, and satisfactory printing can be obtained.

Herein, the Beck's smoothness can be measured by a Beck's smoothness tester. The Beck's smoothness tester is to measure the time required a fixed amount (10 cc) of air to pass between a glass surface and a testing piece in a pressure-reduced state where a testing piece is pressed, at a fixed pressure level (1 kgf/cm$^2$ (9. 8N/cm$^2$)), on a circular glass plate that has been highly smoothly finished and has a hole at its middle.

Next, a description is given of a printing medium that is used for the invention.

As a printing medium, wood-free paper that is normally employed for printing, slightly coated paper, coated paper, etc., may be listed. Also, for example, polyolefin laminated paper having a resin film layer on the surface thereof, plastic film, for example, polyester film, polystyrene film, vinyl chloride film, polyolefin film, etc., may be also used. In addition, plastic film or processed paper having metal deposited thereon or a metallic foil adhered thereonto may be used. As a matter of course, paper or film exclusive for ink jet may be also used.

The oil-based ink which can be used in the present invention is described in more detail below.

The oil-based ink used in the present invention is a dispersion comprising resin particles which are solid and hydrophobic at least at ordinary temperature dispersed in a nonaqueous solvent having an inherent electrical resistance of $10^9$ Ω-cm or more and a dielectric constant of 3.5 or less.

Preferred examples of the nonaqueous solvent having an inherent electrical resistance of $10^9$ Ω-cm or more and a dielectric constant of 3.5 or less include straight-chain or branched aliphatic hydrocarbons, alicyclic hydrocarbons, aromatic hydrocarbons and halogenated products of these hydrocarbons. Specific examples thereof include hexane, heptane, octane, isooctane, decane, isodecane, decaline, nonane, dodecane, isododecane, cyclohexane, cyclooctane, cyclodecane, benzene, toluene, xylene, mesitylene, Isopar C, Isopar E, Isopar G, Isopar H and Isopar L ([Isopar] ISOPAR: tradenamne, a product of Exxon Corp.), Sheilsol 70 and Shellsol 71 ([Shellsoll SHELLSOL: tradename, product of Shell Oil Corp.), Amnsco OMS and Amsco 460 Solvent ([Amsco] AMSCO: tradename, product of American Mineral Spirits Corp.), and silicone oils. They can be used singly or as a mixture of two or more thereof. As to the nonaqueous solvent, the upper limit of the inherent electrical resistance value is of the order of $10^{16}$ Ω-cm, and the lower limit of the dielectric constant value is about 1.9.

The reason why the inherent electrical resistance of the nonaqueous solvent to be used is defined as mentioned above is that when the inherent electrical resistance of the nonaqueous solvent is lowered, the resin particles cannot be highly concentrated, causing the recorded dots to run or deteriorating the press life. The reason why the dielectric constant of the nonaqueous solvent to be used is defined as mentioned above is that when the dielectric constant of the nonaqueous solvent is raised, the electrical field in the ink can be easily relaxed, hence causing the recorded dots to run or deteriorating the ejection of dot.

As the resin particles to be dispersed in the nonaqueous solvent as described above are hydrophobic resin particles which are solid at temperature of 35° C. or less and have good affinity with the nonaqueous solvent. As such a hydrophobic resin, a resin (P) having a glass transition temperature of from −5° C. to 110° C. or a softening temperature of from 33° C. to 140° C. is preferred. The more preferable range of the glass transition temperature is from 10° C. to 100° C., and that of the softening temperature is from 38° C. to 120° C. In particular, it is preferred to have a glass transition temperature of from 15° C. to 80° C. or a softening temperature of from 38° C. to 100° C.

By using a resin having such a glass transition temperature or a softening temperature as described above, the affinity of each resin particle with the image-receiving surface of the original printing plate is enhanced and the resin particles are firmly bonded with each other on the original printing plate. Thus, the adhesion of the ink image to the original printing plate is increased and the press life is improved. On the contrary, if the glass transition temperature or a softening temperature of the resin used is beyond the upper and lower limits specified above, the affinity of each resin particle with the image-receiving surface of the original printing plate may be lowered and the bond between resin particles may be weakened.

The weight-average molecular weight (Mw) of the resin (P) is preferably from $1\times10^3$ to $1\times10^6$, more preferably from $5\times10^3$ to $8\times10^5$, and still more preferably from $1\times10^4$ to $5\times10^5$.

Specific examples of such a resin (P) include olefin homopolymers and copolymers (such as polyethylene, polypropylene, polyisobutylene, ethylene-vinyl acetate copolymer, ethylene-acrylate copolymer, ethylene-methacrylate copolymer and ethylene-methacrylic acid copolymer), vinyl chloride homopolymers and copolymers (such as polyvinyl chloride and vinyl chloride-vinyl acetate copolymer), vinylidene chloride copolymers, vinyl alkanoate homopolymers and copolymers, allyl alkanoate homopolymers and copolymers, homopolymers and copolymers of styrene and derivatives thereof (such as butadienestyrene copolymer, isoprene-styrene copolymer, styrene-methacrylate copolymer and styrene-acrylate copolymer), acrylonitrile copolymers, methacrylonitrile copolymers, alkyl vinyl ether copolymers, acrylate ether homopolymers and copolymers, methacrylate ether homopolymers and copolymers, itaconic acid diester homopolymers and copolymers, maleic anhydride copolymers, acrylamide copolymers, methacrylamide copolymers, phenol resins, alkyd resins, polycarbonate resins, ketone resins, polyester resins, silicone resins, amide resins, hydroxyl and carboxyl-modified polyester resins, butyral resins, polyvinyl acetal resins, urethane resins, rosin resins, hydrogenated rosin resins, petroleum resins, hydrogenated petroleum resins, maleic acid resins, terpene resins, hydrogenated terpene resins, chroman-indene resins, cyclized rubber-methacrylate ether copolymers, cyclized rubber-acrylate ether copolymers, copolymers containing a heterocyclic ring containing no nitrogen atom (as the heterocyclic ring, e.g., furan ring, tetrahydrofuran ring, hiophene ring, dioxane ring, dioxofuran ring, lactone ring, benzofuran ring, benzothiophene ring and 1,3-dioxetane ring), and epoxy resins.

It is desirable for the resin particles to be contained in the oil-based ink of the invention in an amount of from 0.5 to 20% by weight based on the total ink content. If the amount of the resin particles is too low, the affinity of the ink with the surface of the printing original plate is insufficient, and, as a result, the ink may not form images of good quality and the press life tends to decrease. On the other hand, if resin particles is increased, it may be difficult to form a homogeneous dispersion, and, as a result, the ink clogs the ejection head and stable ink ejection may not be achieved.

For the oil-based ink used in the present invention, it is preferred to include a coloring material together with the dispersed resin particles in order to allow easy visual inspection of the resulting printing plate.

Such a coloring material may be any of a number of pigments and dyes which have been ordinarily used in conventional oil-based ink compositions and liquid developers for electrostatic photography.

The pigment to be used has no particular restriction, and includes both inorganic and organic pigments which are ordinarily used in the field of printing. Examples of pigments usable in the oil-based ink without any restriction include carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolidone pigments, dioxazine pigments, threne pigments, perylene pigments, perylone pigments, thioindigo pigments, quinophthalone pigments, metal complex pigments, and other conventionally known pigments.

As the dyes, oil-soluble dyes are suitable for use in the oil-based ink, with examples including azo dyes, metal complex dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes and metallo-phthalocyanine dyes.

The pigments and dyes may be used singly, or they can be used in appropriate combinations. It is desirable that they are contained in a proportion of from 0.01 to 5% by weight based on the total ink content.

Such a coloring material as described above may be dispersed in the nonaqueous solvent as dispersed particles separately from the dispersed resin particles, or it may be incorporated into the dispersed resin particles dispersed in the nonaqueous solvent. In the latter case, the incorporation of a pigment is ordinarily effected by coating the pigment with the resin material of dispersed resin particles to form resin-coated particles, while the incorporation of a dye is ordinarily effected by coloring the surface portion of dispersed resin particles with the dye to form colored particles.

The average diameter of the resin particles, including colored particles, dispersed in the nonaqueous solvent is preferably from 0.05 to 5 $\mu$m, more preferably from 0.1 to 1.5 $\mu$m. The diameter of the particles is determined with a particle size analyzer, CAPA-500 (tradename, manufactured by Horiba Ltd.).

The nonaqueous dispersion of resin particles used in the present invention can be prepared using a well-known mechanical grinding method or a polymerization granulation method. In the mechanical grinding method, the materials for forming resin particles are mixed, molten and kneaded, if required, and directly ground into fine particles with a conventional grinder, and further dispersed in the presence of a dispersing machine (e.g., a ball mill, a paint shaker, a Keddy mill, a Dyno mill with dispersing polymer). In another mechanical grinding method, the materials for forming resin particles and a dispersion assisting polymer (a covering polymer) are kneaded in advance to form a kneaded matter, then ground into fine particles, and further dispersed in the presence of a dispersing polymer. Methods of preparing paints or liquid developers for electrostatic photography can be adopted in practice. Details of these methods are described, e.g., in "Toryo no Ryudo to Ganryo Bunsan (Flow of Paints and Dispersion of Pigments)", translated under the supervision of Kenji Ueki, Kyoritsu Shuppan (1971), Solomon, "Paint Science", Hirokawa Shoten, (1969), Yuji Harada "Coating Engineering", Asakura Shoten (1971), Yuji Harasaki, "Coating no Kiso Kagaku (Elementary Course of Coating Science)", Maki Shoten (1977), etc.

For the polymerization granulation method, well-known methods for dispersion polymerization in nonaqueous media can be employed. Details of such methods are described, e.g., in The Newest Technology of Super-Fine Polymer Particles, Chapter 2, edited under the supervision of Soichi Muroi, CMC Shuppan (1991), The Latest Systems for Electrophotographic Development, and Development and Application of Toner Materials, Chapter 3, edited by Koichi Nakamura, Nippon Kagaku Joho K.K. (1985), and K. B. J. Barret, Dispersion Polymerization in Organic Medium, John Wiley (1975).

In order to stabilize the particles dispersed in the nonaqueous solvent, the particles are generally dispersed together with a dispersing polymer. The dispersing polymer contains repeating units soluble in the nonaqueous solvent as the main component, and a weight-average molecular weight (Mw) thereof is preferably from $1\times10^3$ to $1\times10^6$, more preferably from $5\times10^3$ to $5\times10^5$.

Suitable examples of the soluble repeating units of the dispersing polymer usable in the present invention include a polymerizing component represented by the following formula (I):

(I)

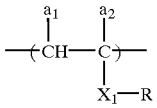

In the general formula (I), XI represents —COO—, —OCO— or —O—

R represents an alkyl or alkenyl group having from 10 to 32 carbon atoms, preferably an alkyl or alkenyl group having from 10 to 22 carbon atoms, which may have a straight-chain or branched structure and may be 'substituted, although the unsubstituted form is preferred.

Specific examples of the alkyl group include decyl, dodecyl, tridecyl, tetradecyl, hexadecyl, octadecyl, eicosanyl, docosanyl, decenyl, dodecenyl, tridecenyl, hexadecenyl, octadecenyl or linolenyl.

The suffixes $a_1$ and $a_2$, which may be the same or different, each represents a hydrogen atom, a halogen atom (e.g., chlorine or bromine atom), a cyano group, an alkyl group having from 1 to 3 carbon atoms (e.g., methyl, ethyl or propyl), —COO—$Z_1$ or —$CH_2$COO—$Z_1$ (wherein $Z_1$ represents a hydrocarbon group having not more than 22 carbon atoms which may be substituted (such as an alkyl, alkenyl, aralkyl, alicyclic or aryl group).

Preferred examples of the hydrocarbon group represented by $Z_1$ include an unsubstituted or substituted alkyl group having from 1 to 22 carbon atoms (e.g., methyl, ethyl, propyl, butyl, hexyl, heptyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl or 3-bromopropyl), an unsubstituted or substituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl or linolenyl), an unsubstituted or substituted aralkyl group having from 7 to 12 carbon atoms (e.g., benzyl, phenetyl, 3-phenylpropyl, naphthylmethyl, 2-naphthylethyl, chlorobenzyl, bromobenzyl, methylbenzyl, ethylbenzyl, methoxybenzyl, dimethylbenzyl or dimethoxybenzyl), an unsubstituted or substituted alicyclic group having from 5 to 8 carbon atoms (e.g., cyclohexyl, 2-cyclohexylethyl or 2-cyclopentylethyl) and an unsubstituted or substituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl or dodecyloxylamidophenyl)].

In addition to the repeating units represented by formula (I), the dispersing polymer may contain other repeating units as copolymerizing components. The copolymerizing components may be derived from any monomers as long as they can be copolymerized with the monomers corresponding to the repeating units of formula (I).

The suitable proportion of the repeating unit represented by formula (I) in the dispersing polymer is preferably at least 50% by weight, more preferably at least 60% by weight.

Specific examples of the dispersing polymer include materials described in Japanese Patent Unexamined Publication No. Hei. 10-204354, Japanese Patent Unexamined Publication No. Hei. 10-204356, Japanese Patent Unexamined Publication No. Hei. 10-259336, Japanese Patent Unexamined Publication No. Hei. 10-306244, Japanese Patent Unexamined Publication No. Hei. 10-316917, Japanese Patent Unexamined Publication No. Hei. 10-316920, etc, Dispersion Stabilizing Resin (Q-1) used in Examples described hereinafter and commercially available products, e.g., Sorprene 1205 manufactured by Asahi Chemical Industry Co., Ltd.

In preparing the resin (P) particles in the state of an emulsion (latex), it is preferred that the dispersing polymer be added prior to the polymerization.

The amount of the dispersing polymer to be added is from 1 to 50% by weight relative to the resin (P) for particles.

In the oil-based ink employed in the present invention, it is desirable that the dispersed resin particles and colored particles (or the particles of coloring material) be electroscopic particles charged positively or negatively.

In order to impart electroscopicity to those particles, wet developer technology for electrostatic photography can be appropriately utilized. Specifically, electroscopicity can be imparted to the particles by using a charge control agent and other additives as described, e.g., in "Saikin no Denshi Shashin Genzo System to Toner Zairyou no Kaihatsu Kitsuyouka (The Latest Systems for Electrophotographic Development, and Development and Application of Toner Materials)", pp. 139–148, described above, "Denshi Shashin Gijutsu no Kiso to Oyo (The Fundamentals and Applications of Electrophotographic Techniques)", edited by Electrophotographic Society, pp. 497–505, Corona Co. (1988), and Yuji Harasaki, "Denshi Shashin (Electrophotography)", vol. 16 (No. 2), p. 44 (1977).

In addition, details of those materials are described, e.g., in British Patents 893,429, 934,038 and 1,122,397, U.S. Pat. Nos. 3,900,412 and 4,606,989, Japanese Patent Unexamined Publication No. sho 60-179751, Japanese Patent Unexamined Publication No. sho 60-185963 and Japanese Patent Unexamined Publication No. Hei 2-13965.

The charge control agent as described above is preferably used in an amount of from 0.001 to 1.0 parts by weight per 1,000 parts by weight of dispersing medium as a carrier liquid. Although, various kinds of additives can be further added, the total amount of additives has an upper limit because it is restricted by the electrical resistance allowable for the oil-based ink. More specifically, if the ink has an inherent electrical resistance of lower than $10^9$ Ω-cm under the condition that the dispersed particles are removed from the ink, it is made difficult to obtain satisfactorily continuous graduation image. Therefore, it is necessary that the amount of each additive added be controlled within the above described limitation.

The present invention will be further described in the following examples, but the present invention should not be construed as being limited thereto.

An example of a preparation of resin particles (PL) suitable for the ink will be described below.

Preparation Example 1 of Resin Particle (PL-1)

A mixed solution of 10 g of Dispersion Stabilizing Resin (Q-1) having the structure illustrated below, 100 g of vinyl acetate, and 384 g of Isopar H was heated to a temperature of 70° C. under nitrogen gas stream with stirring. To the solution was added 0.8 g of 2,2'-azobis(isovaleronitrile) (abbreviated as A.I.V.N.) as a polymerization initiator, followed by reacting for three hours. Twenty minutes after the addition of the polymerization initiator, the reaction mixture became white turbid, and the reaction temperature rose to 88° C. Further, 0.5 g of the above-described polymerization initiator was added to the reaction mixture, and the reaction was carried out for two hours. Then, the temperature of the reaction mixture was raised to 100° C., and stirred for two hours to remove the unreacted vinyl acetate by distillation. After cooling, the reaction mixture was passed through a nylon cloth of 200-mesh to obtain a white dispersion. In the polymerization process, the percent polymerization was90%. The white dispersion obtained was a latex of good monodispersity having an average particle diameter of 0.23 μm. The average particle diameter was measured by CAPA-500 (manufactured by Horiba Ltd.).

Dispersion Stabilizing Resin (Q-1)

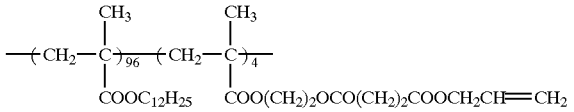

Mw: $5\times10^4$ (composition ratio: by weight)

A portion of the above-described white dispersion was centrifuged at a rotation of $1\times10^4$ r.p.m. for 60 minutes and the thus-precipitated resin particles were collected and dried. The weight-average molecular weight (Mw) of the resin particles was $2\times10^5$ (a GPC value in terms of polystyrene) and the glass transition temperature (Tg) thereof was 38° C.

EXAMPLE 1-1

An oil-based ink was prepared in the following manner.

Preparation of Oil-based Ink (IK-1)

In a paint shaker (manufactured by Toyo Seiki K.K.), 10 g of copolymer of dodecyl methacrylate and acrylic acid (copolymerization ratio: 95/5 by weight), 10 g of nigrosine and 30 g of Shellsol 71 were placed together with glass beads, and the mixture was dispersed for four hours to prepare a fine dispersion of nigrosine.

A mixture of 60 g (as a solid basis) of Resin Particles (PL-1) prepared in Preparation Example 1, 2.5 g of the above-described dispersion of nigrosine, 15 g of FOC-1400 (tetradecyl alcohol, produced by Nissan Chemical Industries, Ltd.) and 0.08 g of copolymer of octene and semimaleic acid hexadecylamide was diluted with one liter of Isopar G, thereby preparing oil-based black ink.

An ink tank of an ink jet recording device of an on-press recording type lithographic printing apparatus (see FIGS. 1 and 2) was filled with 2 liters of Oil-Based Ink (IK-1) thus prepared. A 150 (dpi) 61-channel multiple-channel head as shown in FIG. 3 was used as an ejection head. A drop-in type heater and stirring blades were installed for controlling the ink temperature in the ink tank. The ink temperature was set at 30° C. Temperature control was carried out with a thermostat while rotating the stirring blades at 30 r.p.m. Rotation of the stirring blades was also utilized for preventing precipitation and aggregation. Further, a portion of the ink flow course was made transparent, which portion was arranged between a light emission diode (LED) and a light detector, concentration control of the ink was carried out by feeding diluent for the ink (Isoper G) or concentrated ink (the solid concentration of which was adjusted to twice that of Oil-Based Ink (IK-1)).

An aluminum plate having a thickness of 0.12 mm which had been subjected to graining and anodizing treatment was used as a plate material. The plate material was mounted on the plate cylinder with the head and end thereof being gripped by a mechanical device provided on the plate cylinder. With the dampening water supplier, the printing ink supplier and the blanket cylinder being separated from the plate material, dust on the plate material surface was removed by air-pump suction. Then, the ejection head was moved close to the plate material until it reached the recording position. Image data to be printed was transmitted to an image date calculation controlling unit. The oil-based ink was ejected onto the aluminum plate material, thereby forming an image on the aluminum plate material. During ejection, the ejection electrode of the ejection head had a tip width of 10 μm, and the distance between the head and the plate material was kept at 1 mm by utilizing output from an optically gap-detecting device. A voltage of 2.5 kV was always applied as a bias voltage, and a pulse voltage of 500 V was further superimposed for each ejection of ink. The duration of pulse voltage was changed stepwise from 0.2 millisecond to 0.05 millisecond in 256 steps, thereby changing the dot area for recording. As a result, deterioration of image quality due to a change in dot size was not observed at all even when the ambient temperature varied during the plate-making procedure and the number of printing plates prepared with the apparatus was increased. In other words, satisfactory plate-making was accomplished.

The image formed on the plate material was hardened by heating with a xenon flash fixing device (made by USHIO INC.) under a luminous intensity of 200 J/pulse, thereby preparing a printing plate. Then, the ink jet recording device was moved away together with the subsidiary scanner from the position close to the plate cylinder and kept apart at a distance of 50 mm from the plate cylinder for the purpose of protecting the ejection head. Thereafter, printing was effected on printing coated paper using an ordinary lithographic printing method. In some detail, a printing ink and a dampening water were given to the printing plate to form a printing image thereon. The printing ink image thus formed was then transferred to the blanket cylinder rotating together with the plate cylinder.

On the other hand, image recording was effected in the same manner as in Example 1-1 except that a 200 dpi (distance between electrodes: 127 μm) 64-channel head was used. As a result, the image thus printed was remarkably subject to phenomenon shown in FIGS. 12 and 13. Thus, dots to be ejected disappeared. Further, dots ejected from the edge electrode at both ends showed an error of 50% in distance between electrodes at maximum. Accordingly, the image quality thus obtained was not worth evaluating. Subsequently, the printing ink image on the blanket cylinder was transferred to a printing coated paper passing through the gap between the blanket cylinder and the impression cylinder.

The print after printing 10,000 sheets had a very sharp image without the occurrence of missing, fading or sharpening of the printed image. After the completion of plate-making, the ejection head was cleaned by supplying Isopar G to the head and dripping the Isopar G from the opening of the head for 10 minutes. Then, the head was stored in a cover filled with vapor of Isopar G. By this treatment, prints of good quality were provided for 3 months without any other work for maintenance.

EXAMPLE 1-2

A circulation pump was used as a stirring means, and a multi-channel head of 256 channels, which is a 100 dpi as has been typed in FIG. 5, FIG. 7 or FIG. 9, is disposed. A pump is used, an ink reservoir is, respectively, provided at an ink flow course between the pump and the ejection head, and between the ink recovery course of the ejection head and the ink tank. Then, ink is circulated by a difference in the static pressure between these courses. A heater and the above-described pump are used as a means for controlling an ink temperature, wherein the ink temperature is set to 35° C. and is controlled by a thermostat. Herein, the circulation pump was also used as an stirring means for preventing precipitation and aggregation. In addition, a conductivity measuring device is disposed in the ink flow course, wherein the concentration of ink is controlled by diluting the ink or concentrating the same on the basis of the signals outputted from the conductivity measuring device. As a plate material, the above-described aluminum plate was mounted on the plate cylinder of a lithographic printing apparatus. After dust on the surface of the plate material is removed by a nylon-made rotary brush, data of an image to be printed are transmitted to the image data calculation controlling unit, and the image is recorded by a full-line head while rotating the plate cylinder. Oil-based ink is ejected onto the aluminum plate to form the image. Any defective image due to dust cannot be found, and the image can be prevented from deteriorating due to changes in the dot diameters even by changes of the outer temperature and/or an increase in the number of plates made, wherein satisfactory plate making can be achieved. Subsequently, the image is fixed by a heated roller (made by HITACHI KINZOKU, and its consumption power is 1.2 kw), is strengthened, and is made into a printing plate.

Using the printing plate thus made, printing was then conducted. As a result, the print obtained had a very sharp image without the occurrence of missing, fading or sharpening of image even after printing 10,000 sheets. After the completion of plate-making, the ejection head was cleaned by circulating Isopar G therethrough and then bringing nonwoven fabric impregnated with Isopar G into contact with the tip of the head. By this treatment, prints of good quality were provided for 3 months without any other work for maintenance.

EXAMPLE 1-3

A 50 (dpi) 128-channel multiple channel head as shown in FIG. 7 was mounted as an ejection head on the ink jet recording device of an on-press recording type four-color single-sided lithographic printing apparatus (see FIG. 10). Using a contact roller made of TEFLON, the gap was adjusted to 0.8 mm. 5,000 sheets of printing plates were then prepared in the same manner as in Example 1 except that the ink tank was replenished with a concentrated ink according to the number of sheets having the ink concentration control means. As a result, the image thus formed on the plate material showed no defects due to dust and was not affected by the change of the ambient temperature. As the number of sheets of printing plates made increased, the diameter of dots printed showed some but an acceptable change. The printing plates thus made were also subjected to flash fixing as mentioned above and fixing by irradiation with light from a halogen lamp (Type QIR, produced by USHIO INC.), or fixed with a spray of ethyl acetate.

For the fixing by irradiation with a halogen lamp, heating was effected so that the temperature of the surface of the printing plate reached 95° C. for 20 seconds. For the fixing with spray of ethyl acetate, the amount of ethyl acetate sprayed was adjusted to about 1 g/m$^2$. As a result, the print after printing 10,000 sheets had a very sharp full-color image without the occurrence of fading or sharpening of the printed image. In particular, the fixing time in heated roller fixing or fixing by irradiation with light from a halogen lamp was drastically reduced by wrapping a heat insulator material (PET film) around the plate cylinder. In this case, the aluminum substrate was grounded through an electrically-conductive brush (Thunderlon, produced by Tuchiya K.K.; resistance: about $10^{-1}$ Ω-cm) which comes in contact therewith.

EXAMPLE 1-4

The procedure of Example 1-1 was followed except that the aluminum plate material was replaced by a paper plate material having a hydrophilic image-receiving layer provided on the surface thereof.

Wood-free paper having a basis weight of 100 g/M$^2$ was used as a substrate and, on both sides of the substrate, a water-resistant layer composed of as main ingredients kaolin and resin components, including polyvinyl alcohol, SBR latex and melamine resin, was provided to form a paper support. A dispersion A prepared from the following composition in the following manner was applied to the paper support in a dry coating amount of 6 g/m$^2$ to form an image-receiving layer, thereby preparing a paper plate material.

Dispersion A

- Gelatin (1st grade, produced by Wako Pure Chemical Industries, Ltd.) 3 g
- Colloidal silica (Snowtex C; produced by Nissan Chemical Industries, Ltd.; 20% aqueous solution) 20 g
- Silica gel (Silysya #310, produced by Fuji Silysya Chemical Co., Ltd.) 7 g
- Hardener (paraformaldehyde) 0.4 g
- Distilled water 100 g The foregoing ingredients were subjected to dispersion together with glass beads in a paint shaker for 10 minutes.

The print after printing 10,000 sheets had a very sharp image without the occurrence of fading or sharpening of the printed image On the other hand, wood-free paper was used as the printing paper. During the printing of 3,000th sheet, the image was made solid on some area due to paper dust. Then, an air suction pump was installed as a paper dust generation inhibiting device in the vicinity of the paper supplier. As a result, no defectives in printing occurred. The print after printing 5,000 sheets had a very sharp image without the occurrence of fading or sharpening of the printed image. However, the print after printing 5,000 sheets showed a longitudinal elongation of 0.1 mm on A3 size image.

EXAMPLE 1-5

The same procedure as in Example 1-1 was performed, except that the aluminum plate was replaced with a plate material provided with an image-receiving layer capable of being rendered hydrophilic upon an oil-desensitizing treatment described below, the non-image area of the printing plate prepared was rendered hydrophilic using a plate surface oil-desensitizing device after preparing the printing plate, the conductive layer of the plate material was grounded by contact with a conductive plate spring (made of phosphor bronze) during the recording operation, and fixing was carried out by exposing the plate material to hot air.

Wood-free paper having a basis weight of 100 g/m$^2$ was used as a substrate and, on both sides of the substrate, a polyethylene film was laminated in a thickness of 20 μm to form a water-resistant paper support. On one side of the thus-prepared paper support, a coating for conductive layer having the following composition was coated in a dry coating amount of 10 g/m$^2$ to form a conductive layer and further thereon Dispersion B prepared in the manner indicated below was coated in a dry coating amount of 15 g/m$^2$ to form an image-receiving layer, thereby preparing a plate material.

Coating for Conductive Layer

A coating was prepared by mixing 5.4 parts of carbon black (30% aqueous dispersion), 54.6 parts of clay (50% aqueous dispersion), 36 parts of SBR latex (solid content: 50%, Tg: 25° C.) and 4 parts of melamine resin (solid content: 80%, Sumirez Resin SR-13), and then adding water thereto so as to have the total solid content of 25%.

Dispersion B:

A mixture of 100 g of dry-type zinc oxide, 3 g of Binder Resin (B-1) having the structure shown below, 17 g of Binder Resin (B-2) having the structure shown below, 0.15 g of benzoic acid and 155 g of toluene was dispersed using a wet-type dispersing machine (Homogenizer made by Nippon Seiki Co., Ltd.) at 6, 000 r.p.m. for 8 minutes.

Binder Resin (B-1)

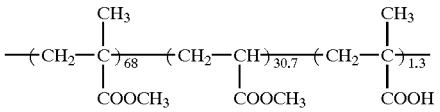

Mw: 9 x 10$^3$

Binder Resin (B-2)

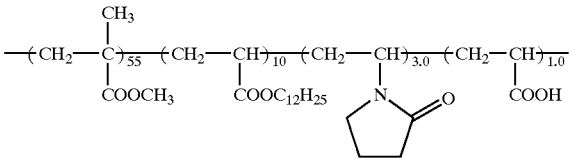

Mw: 4 x 10$^4$ (composition ratio: by weight)

The print after printing 5,000 sheets had a very sharp image without the occurrence of missing, fading or sharpening of the printed image.

EXAMPLE 2-1

In the plate making apparatus 1 (See FIG. 11A and FIG. 2), the ink tank of the ink jet recording device is charged with two liters of oil-based ink (IK-1). Herein, a 150 dpi multi-channel head of 64 channels, which is shown in FIG. 4, was used as the ejection head. A drop-in heater and a stirring blade were provided in the ink tank as the ink temperature controlling means to set the ink temperature to 30° C. The temperature was controlled by a thermostat while turning the stirring blade at 30 r.p.m. Herein, the stirring blade was also used to prevent precipitation and aggregation. In addition, a part of the ink flow line is made transparent, which portion was arranged between an LED (light-emitting diode) and a light detector. The concentration of the ink was controlled by feeding diluent of ink (Isober G) or concentrated ink (the solid concentration of which was adjusted to twice that of Oil-Based Ink (IK-1)).

An aluminum plate of 0.12 mm thick, which is sand-blasted and treated with anode oxidization was used. The aluminum plate is mounted so that the top and tail thereof are gripped by a mechanical device secured on the drum of the plate making device. After dust on the surface of the plate material is removed by means of air pump suction, the ejection head is moves towards the plate material at the recording position. Image data to be subjected to plate making are transmitted to the image data calculation controlling unit. Herein, the image is formed by discharging oil-based ink onto the aluminum plate by moving the 64-channel ejection head while turning the drum. At this time, the tip end width of the ejection electrode of the ink jet head was set to 10 $\mu$m, and the distance between the head and the plate material was controlled so as to become 1 mm in output from an optical gap detector. A voltage of 2.5 KV was normally applied as a bias voltage, a pulse voltage of 500V was further overlapped when discharging ink, and the pulse voltage was varied in 256 steps in the range from 0.2 milliseconds to 0.05 milliseconds, wherein an image was recorded while varying the dot area. No defects due to dust could be found at all, and no images deteriorated at all due to a change in the ambient temperature, or due to a change in the dot diameters in line with an increase in the number of making plates, and satisfactory plate making could be achieved.

The image was hardened through heating by a xenon flash fixing device (made by Ushio Denki, Light-emitting intensity is 200 J/pulse), and a printing plate was made. In order to protect the ink jet head, the ink jet recording device was retreated 50 mm from the position close to the drum along with the subscanning means. Next, the printing plate was removed from the plate making apparatus. It was mounted on the plate cylinder of an Oliver 266EPZ lithographic printing apparatus, and printing was carried out.

The print after 10,000 sheets had a very clear image without the occurrence of missing, fading or sharpening of the printed image. After the completion of printing, the head was cleaned by supplying Isober G to the head and dropping the Isober G from the opening of the head for 10 minutes. Then, the head was stored in a cover filled with vapor of Isober G. By this treatment, prints of good quality were provided for 3 months without any other work for maintenance.

EXAMPLE 2-2

A 100 dpi multi-channel head of 256 channels and of such a type as shown in FIG. 5 was disposed in the apparatus shown in FIG. 11B. A pump was used to circulate ink, and an ink reservoir is, respectively, provided at an ink flow course between the pump and the ejection head, and between the ink recovery course of the ejection head and the ink tank. Then, ink is circulated by a difference in the static pressure between these courses. A heater and the above-described pump are used as a means for controlling an ink temperature, wherein the ink temperature is set to 35° C. and is controlled by a thermostat. Herein, the circulation pump was also used as an stirring means for preventing precipitation and aggregation. In addition, a conductivity measuring device was disposed in the ink flow course, wherein the concentration of ink is controlled by diluting the ink or inputting the concentrated ink on the basis of the signals outputted from the conductivity measuring device. As a plate material, the above-described aluminum plate was mounted on the drum of the plate making apparatus. After dust on the surface of the plate material is removed by a nylon-made rotary brush, data of an image to be printed were transmitted to the image data calculation controlling unit, and the multi-channel head was moved in the traveling direction of the plate material, and in line with the movement thereof, the image was recorded by discharging oil-based ink onto the aluminum plate by delivering the plate material by means of capstan rollers. Defective images due to dust could not be found, and images could be prevented from deteriorating due to changes in the dot diameters even by changes in the outer temperature and/or an increase in the number of plates made, wherein satisfactory plate making can be achieved. Further, the image was hardened through heating by fixing made by a heated roller (Teflon sealed silicon rubber roller internally including a 300 W halogen lamp), thereby making a printing plate.

In addition, printing was carried out with the completed plate as in Example 1. The print after 10,000 sheets had a very clear image without the occurrence of missing, fading or sharpening of the printed image. Also, the head was cleaned by causing unwoven cloth containing Isober G to be brought into contact with the tip end of the head after the Isober G was circulated to the head after the plate was made, wherein it was possible to make plates, which can bring about satisfactory print, without any further maintenance for three months.

Still further, using a 100 dpi full-line ink jet head of such a type as shown in FIG. 7 and FIG. 9 instead of the ink jet head of such a type as shown in FIG. 5 above, similar printing was carried out, wherein satisfactory results, which are similar to those in the respective abovementioned cases, could be obtained.

EXAMPLE 2-3

Operations that are similar to those in Example 1 were carried out, excepting that a plate material having an image receiving layer provided, which is made hydrophilic by a non-sensing oiling treatment, on the surface shown below was used instead of the aluminum plate in Example 2-1, the non-imaging section was made hydrophilic by using a plate non-sensing treatment device after the printing plate was made, the plate material conductive layer is grounded by being brought into contact with a conductive plate spring (made of phosphor bronze) when recording an image, and hot air is applied to the plate material to carry out fixing.

A plate material was produced below; that is, wood-free paper having a weight of 100 g/m$^2$ was used as the substrate, a polyethylene film 20 $\mu$m thick was laminated on both sides of the substrate to secure a waterproof property, a coating for conductive layer that was adjusted as shown below with the following composition was coated on one side of the paper substrate, the coating amount was determined to be 10 g/m$^2$after drying, and a dispersion A was coated so that the coating amount thereof becomes 15 g/m$^2$ after drying, in order to produce an image receiving layer.

Coating for Conductive Layer

A coating was prepared by mixing 5.4 parts of carbon black (30% aqueous dispersion), 54.6 parts of clay (50 aqueous dispersion), 36 parts of SBR latex (Solid content: 50%, Tg: 25° C.), and 4 parts of melamine resin (Solid content: 80%, Sumirez Resin: SR-613), and then adding water thereto so as to have the total solid content of 25%.

Dispersion A

A mixture of 100 g of dry-type zinc oxide, 3 g of Binder Resin (B-1) having the structure shown above, 17 g of Binder Resin (B-2), 0.15 g of benzoic acid and 155 g of toluene was dispersed using a wet-type dispersing machine (Homogenizer made by Nippon Seiki Co., Ltd.) at a rotation speed of 6,700 r.p.m.

Blister occurred when having executed fixing by applying hot air to the plate material. Then, the fixing was carried out by gradually increasing the supply power to a heater used for generating hot air, or continuously lowering the rotation speed of the drum from a high speed to a low speed without varying the supply power. As a result, no blister occurred, and the print obtained by printing with the printing plate had a very clear image without the occurrence of missing, fading or sharpening of the printed image after printing 5,000.

EXAMPLE 3-1

Two liters of oil-based ink (IK-1) that was prepared as described above was filled in an ink tank of the ink jet recording device with respect to the recording apparatus of a printing apparatus shown in FIG. 14. Herein, a 150 dpi full-line head of such a type as shown in FIG. 5 was used as the ejection head. A drop-in heater and an stirring blade were provided in the ink tank as the ink temperature controlling means to set the ink temperature to 30° C. And, the temperature was controlled by a thermostat while turning the stirring blade at 30 r.p.m. Herein, the stirring blade was also used to prevent precipitation and aggregation. In addition, a part of the ink flow line is made transparent, and an LED (light-emitting diode) and a light detector were disposed at both sides of the transparent section, wherein the concentration of the ink was controlled by feeding diluent for ink (Isober G) or concentrated ink (IK-1) (the solid concentration of which was adjusted to twice that of Oil-Based Ink (IK-1)). A roll-shaped slightly coated paper was provided on the opposed drum as the printing medium and was transferred. The ejection head was moved towards the recording position after dust on the surface of the printing medium was removed by suction made by an air pump, and image data to be printed were transmitted to the image data calculation controlling unit, wherein an image was formed by discharging oil-based ink through the full-line multi-channel head while transferring the printing medium by rotations of the opposed drum. At this time, the tip end width of the ejection electrode of the ink jet head was set to 10 $\mu$m, and the distance between the head and the printing medium was kept at 1 mm by an output from a optical gap detector. A voltage of 2.5KV was normally applied as a bias voltage, a pulse voltage of 500V was further overlapped when discharging ink, and the pulse voltage was varied in 256 steps in the range from 0.2 milliseconds to 0.05 milliseconds, wherein an image was recorded while varying the dot area. No defects in recording an image due to dust could be found at all, and no images deteriorated at all due to a change in the dot diameters resulting from a change in the ambient temperature or an increase in the printing time, wherein satisfactory plate making could be achieved.

The image was hardened through heating by a xenon flash fixing device (made by Ushio Denki, Light-emitting intensity is 200 J/pulse). In order to protect the ink jet head after the printing is finished, the ink jet recording device was retreated 50 mm from the position close to the recording drum.

The print thus obtained had a very clear image without the occurrence of missing, fading or sharpening of the printed image. After the completion of printing, the head was cleaned by supplying Isober G to the head and dropping the Isober G from the opening of the head for 10 minutes. Then, the head was stored in a cover filled with vapor of Isober G. By this treatment, prints of good quality were provided for 3 months without any other work for maintenance.

EXAMPLE 3-2

A printing apparatus shown in FIG. 15 and FIG. 16 was used, and a circulation pump was employed as an stirring means (27 in FIG. 2), and four 100 dpi multi-channel heads of 256 channels and of such a type as shown in FIG. 5 or FIG. 7 were provided. With respect to the ejector equivalent to 64 channels, the heads were disposed so as to be arrayed in the direction orthogonal to the axial direction of the drum.

As oil-based ink, four colors were used, which consists of black ink IK-1, cyan ink IK-2 that was prepared similarly to IK-1, excepting that nigrosin used as a coloring agent of the IK-1 was substituted by phthalocyanine blue, magenta ink IK-3 that was prepared similarly to the IK-1, excepting that nigrosin used as a coloring agent of the IK-1 was substituted by a CI pigment red 57:1, and yellow ink IK-4 that was prepared similarly to the IK-1 ink, excepting that nigrosin used as a coloring agent of IK-1 ink was substituted by CI pigment yellow 14. The respective types of color ink were filled in the respective four heads.

A pump was used, an ink reservoir was, respectively, provided at an ink flow course between the pump and the ejection head, and between the ink recovery course of the ejection head and the ink tank. Then, ink was circulated by a difference in the static pressure between these courses. A heater and the above-described pump were used as a means for controlling an ink temperature, wherein the ink temperature is set to 35° C. and is controlled by a thermostat. Herein, the circulation pump was also used as an stirring means for preventing precipitation and aggregation.

In addition, a continuity measuring device was disposed in the ink flow course, wherein the concentration of ink is controlled by diluting the ink or concentrating the same on the basis of the output signals thereof. After dust on the surface of a printing medium was removed by a nylon rotary brush, the image data to be printed were transmitted to the image data calculation controlling unit, wherein an image was recorded by carrying out the main scanning while moving the head in the axial direction of the drum, and simultaneously, the subscanning while turning the recording drum. And, ink was ejected onto a roll-shaped slightly coated paper to form an image.

No defects due to dust could be found at all, and no images deteriorated at all due to a change in the ambient temperature or due to a change in the dot diameters in line with an increase in the number of making plates. In the case where either one of the types shown in FIG. 5 and FIG. 7, satisfactory single-sided and double-sided full color printing were enabled.

Further, the head was cleaned by causing unwoven cloth containing Isober G to be brought into contact with the tip end of the head after the Isober G was circulated to the head after the printing is completed, wherein it was possible to make plates, which can bring about satisfactory printing, without any further maintenance for three months.

EXAMPLE 3-3

Single-sided four-color Printing was carried out by using a printing apparatus shown in FIG. 18. Four types of color ink described in Example 3-2 were, respectively, used in four sets of ink jet recording apparatuses as oil-based ink. Four 100 dpi multi-channel heads of 256 channels of such a type as shown in FIG. 9 were used. The ejector was disposed in parallel to the axis of the opposed drum, and the main scanning was carried out by rotations of the opposed drum, wherein an image of 900 dpi was recorded on wood-free paper by sequentially moving the heads in the axial direction per rotation, and sharp and high quality full-color print was enabled.

EXAMPLE 3-4

Single-sided four-color printing was carried out by using a printing apparatus shown in FIG. 20 and FIG. 21. The four types of color ink, which are the same as those in Example 3-3 were used as oil-based ink. Herein, a 100 dpi multi-channel head of 64 channels of such a type as shown in FIG. 5 was used as the ejection head, and the ejector was disposed so as to constitute an angle of approx. 60° with respect to the traveling direction of a printing medium. Image data to be printed were transmitted to the image data calculation controlling unit, and the multi-channel head of 64 channels was moved in the direction orthogonal to the transfer direction of the printing medium, wherein an image of 700 dpi was formed on a sheet of paper exclusive to an ink jet by transferring the printing medium by rotations of the capstan rollers. All the other operations were the same as those in Example 3-1, wherein satisfactory four-color print was enabled.

Industrial Applicability

According to the invention, high quality images can be provided in a stabilized state by an electrostatic type ink jet recording method in which a multi-channel head recording apparatus is used. Therefore, it is possible to print images on not only normal paper but also plastic sheets. Also, the invention is applicable to a plate making apparatus corresponding to a digital feature that does not require any development treatment, and to a on-press recording type lithographic printing apparatus, wherein it is possible to simply and inexpensively obtain a number of sharp and high quality print.

What is claimed is:

1. A printing apparatus comprising:

image forming means for directly forming an image onto a plate material by an ink jet recording device which ejects an oil-based ink from a recording head having a plurality of ejection channels according to signals of image data utilizing an electrostatic field, wherein a distance between respective ejection channels of the head is predetermined to be greater than at least the distance between horizontally adjacent dots to be ejected which is determined by the resolution of a desired image to be recorded, wherein the recording head has a distance between the ejection channels of 170 $\mu$m or more, and wherein the image forming means obtains a desired image is obtained by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

2. A printing method comprising:

directly forming an image onto a plate material by an ink jet recording device which ejects an oil-based ink from a recording head having a plurality of ejection channels according to signals of image data utilizing an electrostatic field, predetermining a distance between respective ejection channels of the head to be greater than at least the distance between horizontally adjacent dots to be ejected which is determined by the resolution of a desired image to be recorded, and providing the recording head with a distance between the ejection channels of 170 $\mu$m or more, wherein a desired image is obtained by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

3. A plate making apparatus comprising:

image forming means for directly forming an image on a plate material by an ink jet recording device which ejects an oil-based ink from a recording head having a plurality of ejection channels according to signals of image data utilizing an electrostatic field, wherein a distance between respective ejection channels of the head is predetermined to be greater than at least the distance between horizontally adjacent dots to be ejected which is determined by the resolution of a desired image to be recorded, wherein the recording head has a distance between the ejection channels of 170 $\mu$m or more, and wherein the image forming means obtains a desired image by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

4. A plate making method comprising:

directly forming an image on a plate material by an ink jet recording device which ejects an oil-based ink from a recording head having a plurality of ejection channels according to signals of image data utilizing an electrostatic field, predetermining a distance between respective ejection channels of the head to be greater than at least the distance between horizontally adjacent dots to be ejected which is determined by the resolution of a desired image to be recorded, and providing the recording head with a distance between the ejection channels of 170 $\mu$m or more, wherein a desired image is obtained by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

5. An on-press recording type lithographic printing apparatus comprising:

an image forming means for directly forming an image onto a plate material mounted on a plate cylinder of a press by using an ink jet recording device which ejects an oil-based ink from a recording head having a plurality of ejection channels according to signals of image data utilizing an electrostatic field; and a lithographic printing means for effecting a lithographic printing using a printing plate formed by said image forming means, wherein the image forming means predetermines the distance between the respective ejection channels of the head to be greater than at least the distance between horizontally adjacent dots to be ejected which is determined by the resolution of a desired image to be recorded, wherein the recording head has a distance between the ejection channels of 170 $\mu$m or more, and wherein the image forming means obtains a desired image by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

6. An on-press recording type lithographic printing method comprising:

directly forming an image onto a plate material mounted on a plate cylinder of a press by using an ink jet recording device which ejects an oil-based ink from a recording head having a plurality of ejection channels according to signals of image data utilizing an electrostatic field, a lithographic printing means for effecting a lithographic printing using a printing plate formed by said image forming means, predetermining a distance between the respective ejection channels of the head to be greater than at least the distance between horizontally adjacent dots to be ejected which is determined by the resolution of a desired image to be recorded, and providing the recording head with a distance between the ejection channels of 170 $\mu$m or more, wherein a desired image is obtained by repeatedly performing a step of roughly all channel widths so that no gap is produced after a moving of the distance of adjacent dots which is determined by the resolution of recorded images being repeated a predetermined number of times, so as not to lap the dots over the dots of the adjacent channels.

* * * * *